US005895303A

United States Patent [19]

Kimura et al.

[11] Patent Number: 5,895,303

[45] Date of Patent: Apr. 20, 1999

[54] METHOD OF MANUFACTURING AN ELECTRON GUN FOR A CATHODE RAY TUBE

[75] Inventors: Shingo Kimura; Shigenori Tagami, both of Kanagawa, Japan

[73] Assignee: Sony Corporation, Tokyo, Japan

[21] Appl. No.: 08/838,195

[22] Filed: Apr. 16, 1997

Related U.S. Application Data

[62] Division of application No. 08/546,944, Oct. 23, 1995, Pat. No. 5,773,925.

[30] Foreign Application Priority Data

Oct. 24, 1994 [JP] Japan ..... 6-258586
Oct. 25, 1994 [JP] Japan ..... 6-260658

[51] Int. Cl.[6] ..... H01J 9/18

[52] U.S. Cl. ..... 445/34

[58] Field of Search ..... 445/34, 36

[56] References Cited

U.S. PATENT DOCUMENTS 3,417,448 12/1968 Kelley ..... 445/34

5,489,229 2/1996 Muti et al. ..... 445/34

*Primary Examiner*—Kenneth J. Ramsey

*Attorney, Agent, or Firm*—Hill & Simpson

[57] ABSTRACT

An electron gun comprising at least one cathode for emitting electrons, a cylindrical device, a first electrode layer provided on the cathode side of inner surface of the cylindrical device, a second electrode layer provided on a panel side of inner surface of the cylindrical device, and a third electrode layer provided between the first electrode layer and the second electrode layer, a ratio of a gap between the second electrode and the third electrode to a gap between the first electrode and the third electrode being defined more than 1, wherein the ratio of the gap between the second electrode and the third electrode to the gap between the first electrode and the third electrode is 1:1 to 2, the cylindrical device is made of ceramic, and further comprising at least one resistive layer provided on the inner surface of the cylindrical device, and at least one conductive layer provided between the adjacent electrode layers.

8 Claims, 29 Drawing Sheets

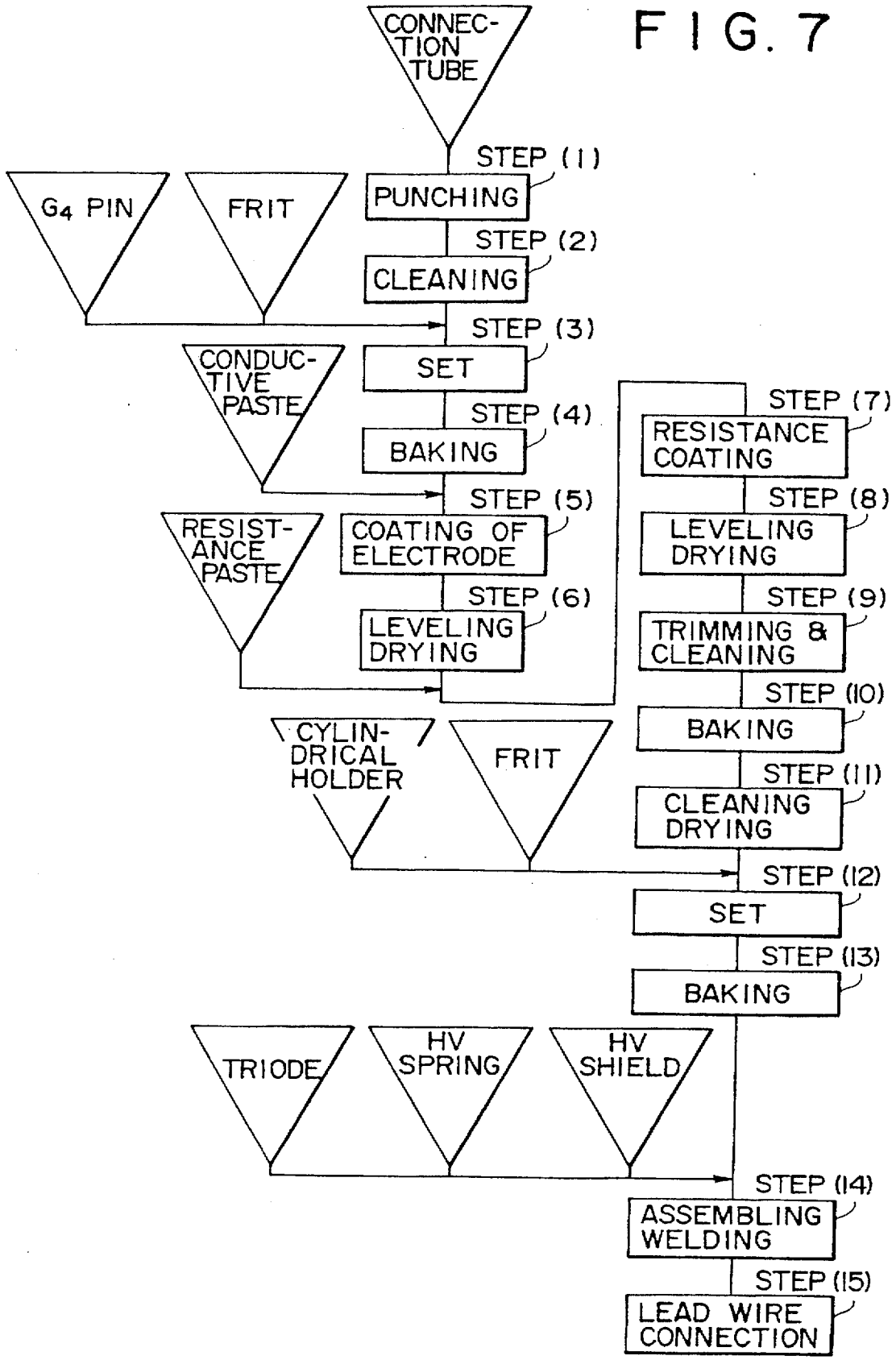
FIG. 7
CONNECTION TUBE
STEP (1)
PUNCHING
G4 PIN
FRIT
STEP (2)
CLEANING
STEP (3)
SET
CONDUCTIVE PASTE
STEP (4)
BAKING
STEP (5)
COATING OF ELECTRODE
RESISTANCE PASTE
STEP (6)
LEVELING DRYING
STEP (7)
RESISTANCE COATING
STEP (8)
LEVELING DRYING
STEP (9)
TRIMMING & CLEANING
STEP (10)
BAKING
CYLINDRICAL HOLDER
FRIT
STEP (11)
CLEANING DRYING
STEP (12)
SET
STEP (13)
BAKING
TRIODE
HV SPRING
HV SHIELD
STEP (14)
ASSEMBLING WELDING
STEP (15)
LEAD WIRE CONNECTION

METHOD OF MANUFACTURING AN ELECTRON GUN FOR A CATHODE RAY TUBE

This is a division of application Ser. No. 08/546,944, filed Oct. 23, 1995, now U.S. Pat. No. 5,773,925.

BACKGROUND OF THE INVENTION

1. Field of the Invention

This invention relates to an electron gun for a cathode ray tube used in a projector tube, a color TV tube and an index tube and the like, for example.

2. Description of Related Art

As the related art electron gun for a cathode ray tube, the gun shown in FIG. 33, for example, is well known in the art.

This electron gun is of a uni-potential type, wherein the first to fifth grids acting as accelerator electrodes and focusing electrodes are coaxially (a Z-axis) arranged against a cathode K for discharging electrons. Then, electron beams discharged from the cathode K are focused on a fluorescent surface under an action of pre-focusing lens formed by the second and third grids $G_2$, $G_3$ and an action of a main lens formed by the third to fifth grids $G_3$ to $G_5$. These cathode K and the first to fifth grids $G_1$ to $G_5$ are fixed to a beading glass through melting and integrally assembled. In addition, the first to fifth grids $G_1$ to $G_5$ are made of metal such as stainless steel, for example.

However, such electron gun had some problems as described below.

That is, in the aforesaid configuration, a certain displacement may easily occur in a degree of concentricity of electrodes, the third to the fifth grids $G_3$ to $G_5$, resulting in that the electron beams may be moved away from an axis to cause a blooming of the electron beams to be easily generated.

In addition, since there was a high potential gradient between the electrodes, an electrical discharging was apt to occur among the third to the fifth grids $G_3$ to $G_5$, a spherical aberration of a lens diameter was increased to cause a beam spot diameter to be increased.

In addition, when a gap between the third grid $G_3$ and the fourth grid $G_4$ and another gap between the fourth grid $G_4$ and the fifth grid $G_5$ are widened by more than a certain space, this operation shows a problem that the electron beams are leaked out and a charge-up occurs at the neck part or the beading glass. These gaps are related to a performance of an electron gun (in particular, a coefficient of spherical aberration) and so it is desired to make the most suitable gap.

SUMMARY OF THE INVENTION

In view of the foregoing, the present invention has been invented and it is an object of the present invention to provide an electron gun for a cathode ray tube in which a gap between the grids can be designed to the most suitable value in which a performance of the electron gun is improved without generating any charging-up at the neck part or the beading glass and the like.

In order to attain the aforesaid object, the electron gun for a cathode ray tube of the present invention is fabricated such that an electron lens composing part is composed of a resistive cylindrical member, at least a ring-shaped first electrode, a ring-shaped third electrode and a ring-shaped second electrode are arranged in this order from a cathode side along an axis within the resistive cylindrical member, and a ratio of a gap between the third electrode and the second electrode against another ratio to a gap between the third electrode and the second electrode is 1 or more, preferably 1 to 3 and more preferably 1 to 2.

The aforesaid resistive cylinder is made of ceramic, for example.

BRIEF DESCRIPTION OF THE DRAWINGS

FIG. 7 is a flow chart for showing manufacturing steps for an electron gun of the preferred embodiment.

DESCRIPTION OF THE PREFERRED EMBODIMENTS

Figure 5:
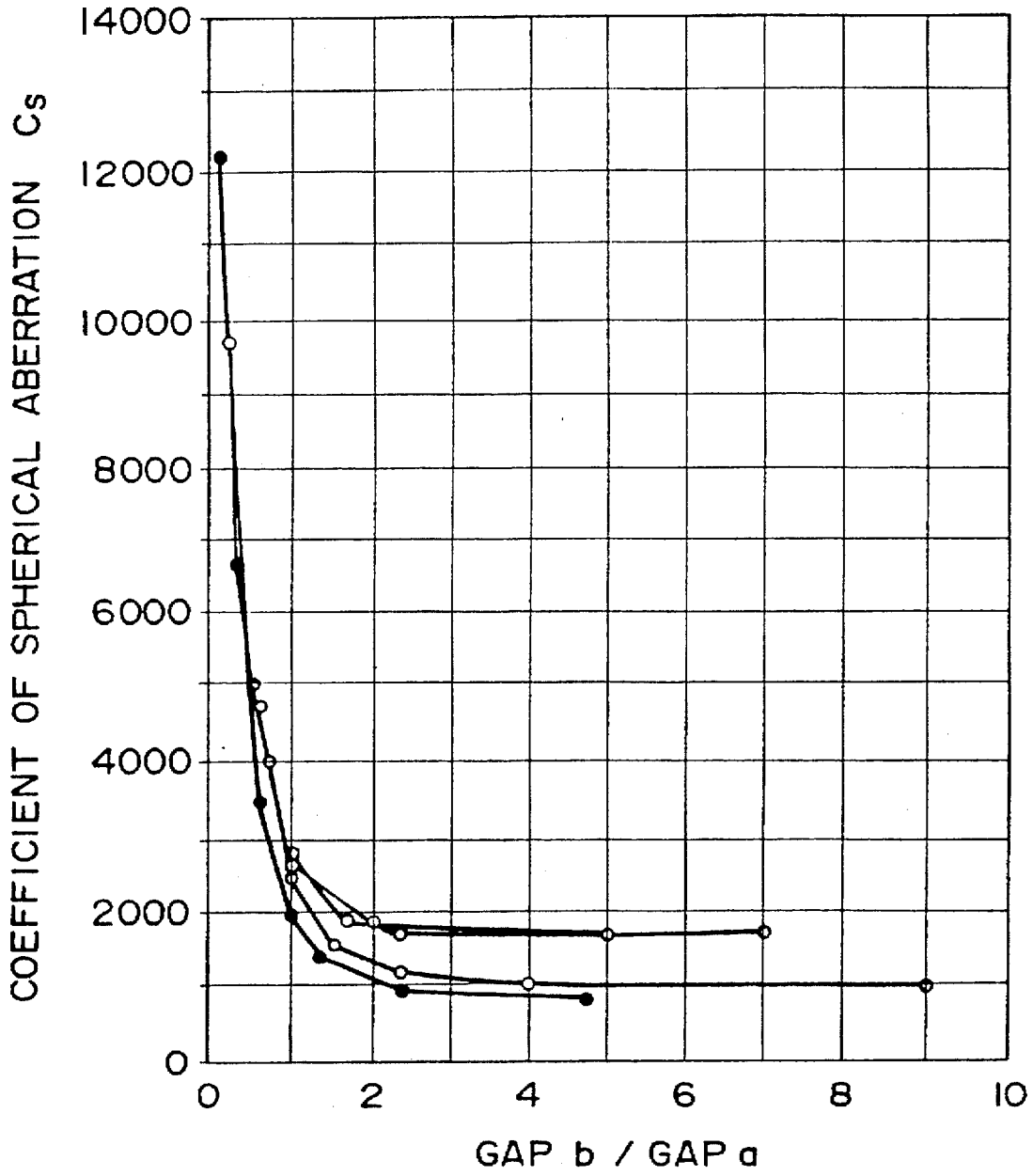
FIG. 5 is a graph for showing a relation between a gap ratio of b/a and a coefficient of spherical aberration.

According to the experiments performed by the present inventors, as shown in FIG. 5, a coefficient of spherical aberration Cs of a lens of an electron gun is substantially changed in the case that a gap ratio between a gap (a) between the first electrode and the third electrode and another gap (b) between the third electrode and the second electrode (b/a) is changed. In this case, an X-axis in FIG. 5 is b/a and a Y-axis is a coefficient of spherical aberration. The coefficient of spherical aberration Cs may substantially influence against a spot diameter of the cathode ray tube. A spot diameter D can be expressed by the following equation.

$$D=dc\times M+\tfrac{1}{2}\times Cs\times M\times\theta^3:$$

where, dc is a spot diameter, M is an amplification rate and θ is a dispersion angle.

Figure 6:
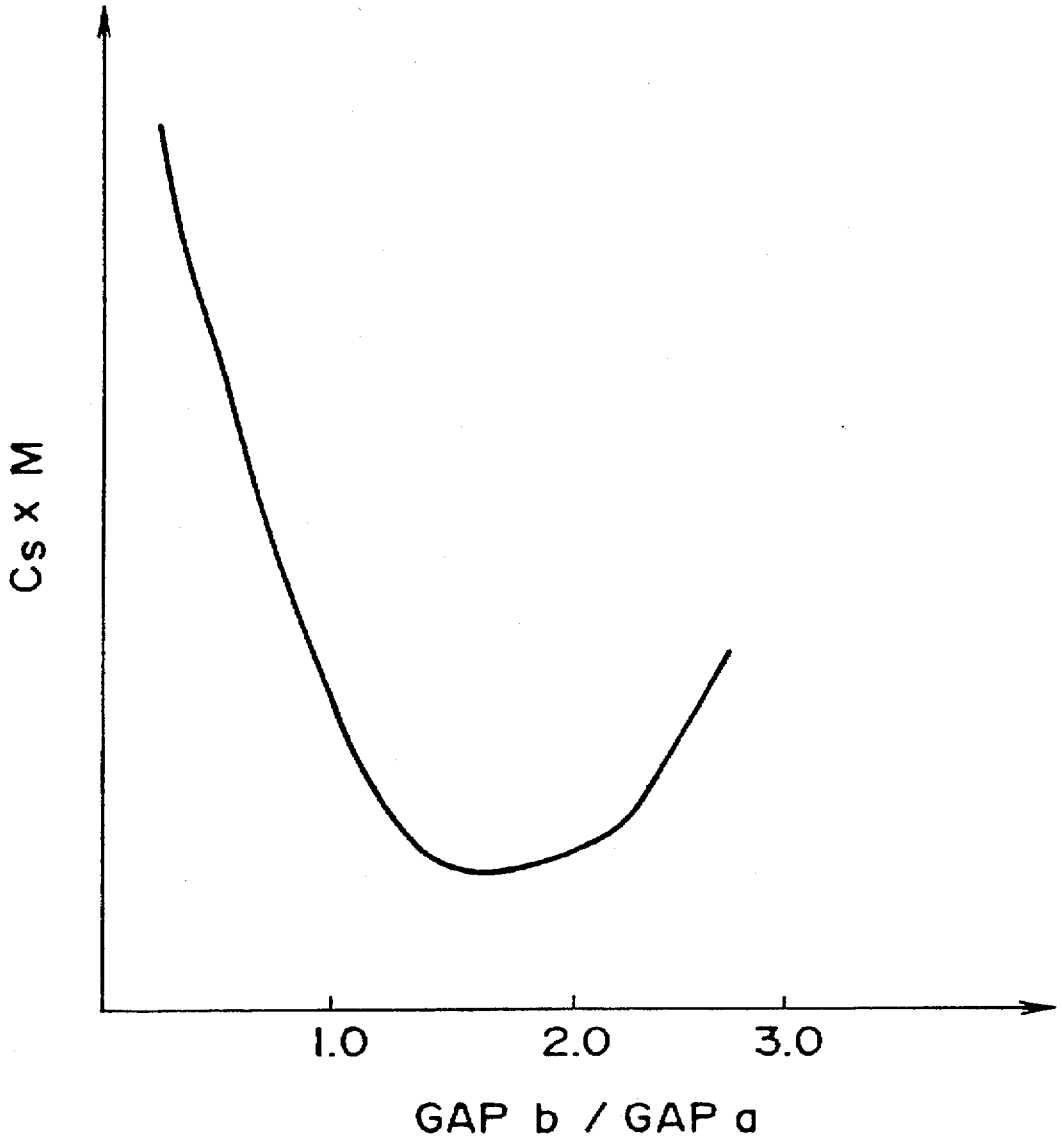
FIG. 6 is a graph for showing a relation between a gap ratio of b/a and a coefficient of spherical aberration x an amplification rate.

From the above-equation, it becomes apparent to be satisfactory that the coefficient of spherical aberration Cs is decreased in order to reduce the spot diameter D. Accordingly, in the present invention, the value of b/a is set to be more than 1 in view of the result shown in FIG. 5. Mere consideration of the coefficient of spherical aberration Cs shows that it is satisfactory if the value of b/a is more than 1 and a further consideration of the amplification rate M also shows that a value of Cs×M has a minimum value against the value of b/a as shown in FIG. 6, so that the value of b/a is practically 1 to 3, preferably 1 to 2 in order to reduce the spot diameter D.

In the present invention, it is possible to set a minimum value of spherical aberration by setting the aforesaid gap ratio b/a to have a predetermined range and thereby it is possible to improve a resolution of a cathode ray tube.

In addition, since the electrodes are formed on the inner surface of resistive cylindrical device, there is no possibility that the electron beams are leaked out of a space between the electrodes and no charged-up state occurs at the beading glass. Further, since the electron lens configuration part is formed by the resistive cylindrical device, a displacement in concentricity of the electron lens system is almost fixed.

Figure 1:
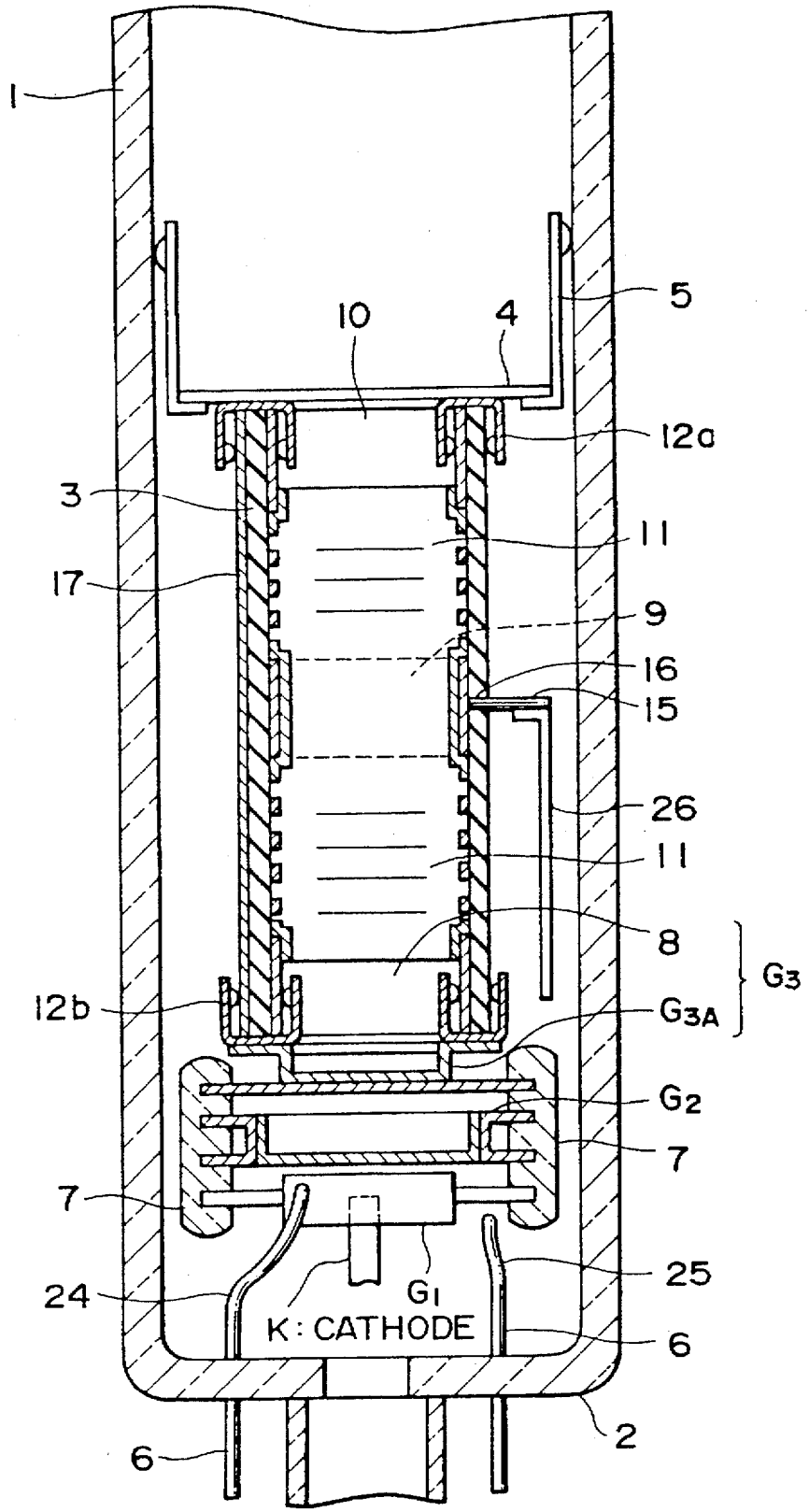
FIG. 1 is a sectional view for illustrating an entire configuration of an electron gun for a cathode ray tube of the first preferred embodiment of the present invention.

An HV spring 5 is made of Inconel, for example. As shown in FIG. 1, the HV spring 5 is fabricated such that it is fixed to both ends of the HV shield 4 by welding and its extremity end presses the inner surface of the neck tube 1. Then, this HV spring 5 is electrically connected to an anode not shown through an electrical conductive layer made of carbon and the like.

As shown in FIG. 41 the preferred embodiment of the present invention is designed such that a gap ratio of a gap (a) between the third grip $G_3$ (the first electrode) 8 and the fourth grid $G_4$ (the third electrode) 9 against a gap (b) between the fifth grid $G_5$ (the second electrode) 10 and the fourth grid $G_4$ is set to be 1 or more, preferably 1 to 3 and more preferably 1 to 2.

Reasons why the aforesaid gap ratio (b/a) is set to the aforesaid range will be described as follows.

As shown in FIG. 5, in the case that the aforesaid gap ratio (b/a) is varied, the coefficient of spherical aberration Cs of a lens of an electron gun is widely changed. In this case, the X-axis in FIG. 5 indicates the ratio of b/a and the Y-axis in FIG. 5 indicates the coefficient of spherical aberration Cs. The coefficient of spherical aberration Cs may substantially influence on the spot diameter of the cathode ray tube. The spot diameter D can be expressed by the following equation.

$$D=dc\times M+\tfrac{1}{2}\times Cs\times M\times\theta^3$$

where, dc is a spot diameter, M is an amplification rate and θ is a dispersion angle.

It is apparent from the above equation that the coefficient of spherical aberration Cs is reduced in order to decrease the spot diameter D. Accordingly, the value of b/a in the preferred embodiment is set to be 1 or more in view of the result shown in FIG. 5. Although a mere consideration of the coefficient of spherical aberration Cs shows that it is satisfactory if the value b/a is 1 or more and also a consideration of even the amplification rate M shows that Cs×M has a minimum value against the value b/a, so that more practically the value b/a is 1 to 3 and preferably 1 to 2 in order to reduce the spot diameter D.

In addition, the practical size of the gap (a) between the third grid $G_3$ and the fourth grid $G_4$ is varied in reference to a size of the cathode ray tube.

In the preferred embodiment, it is possible to set the minimum value of the spherical aberration by setting the aforesaid gap ratio to the predetermined range and thereby to improve a resolution of the cathode ray tube. In addition, since the outer circumferences of the grids $G_3$, $G_4$ and $G_5$ are formed on the inner surface of resistive cylindrical device 3, there is no possibility that the electron beams are leaked out of a space between the grids and charged up at the beading glass.

Then, referring now to FIGS. 7 and 8, the method for manufacturing the electron gun of the preferred embodiment will be described.

Figure 8A:
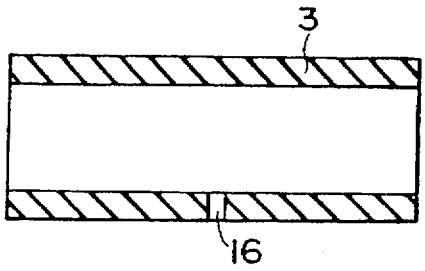
FIGS. 8A to 8G are illustrative views for showing manufacturing steps of the preferred embodiment.
Figure 9:
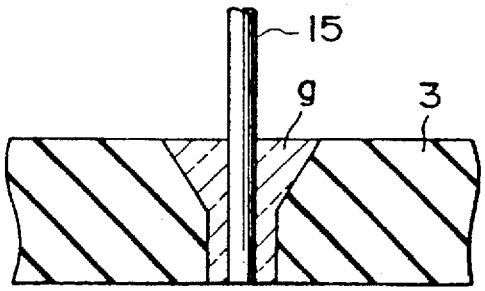
FIG. 9 is a sectional view for showing a fixing part of a $G_4$ pin of the preferred embodiment.

At first, a hole 16 for use in fixing the $G_4$ pin 15 is formed at the resistive cylindrical device 3 (the step (1) in FIG. 7 and FIG. 8A) and then this resistive cylindrical device 3 is cleaned (the step (2) in FIG. 7). Then, as shown in FIG. 9, the $G_4$ pin 15 and the flit glass (g) are set within this hole 16 (the step (3) in FIG. 7).

Figure 8B:
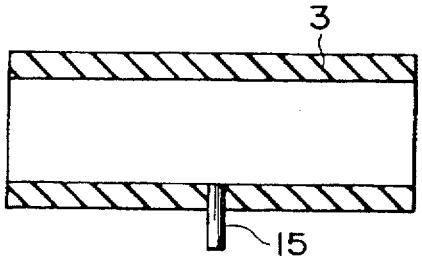

In addition, the $G_4$ pin 15 is fixed by a jig and then a flit baking is carried out under its state (the step (4) in FIG. 7 and FIG. 8B).

Figure 8C:
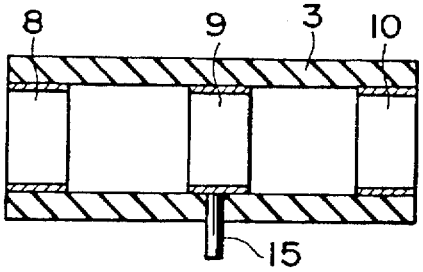

Then, electrodes 8 to 10 are coated and formed at both ends and the central part of the inner surface of the resistive cylindrical device 3 (the step (5) of FIG. 7 and FIG. 8C). In this case, as the electrical conductive paste, $RuO_2$-glass paste (a product name of #9516 manufactured by Dupont), for example, is used so as to cause a film thickness to be made uniform.

Figure 8D:
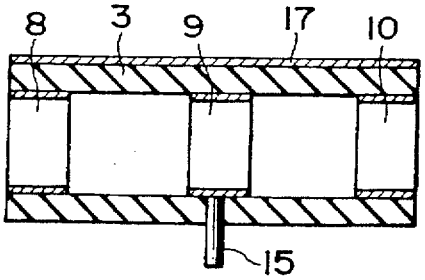

In addition, as shown in FIG. 8D, the aforesaid conductive paste is coated in a longitudinal direction at the outer circumference where the $G_4$ pin 15 of the resistive cylindrical device 3 is not arranged in order to perform an electrical connection between the electrode 8 acting as the third grid $G_3$ and the the electrode 10 acting as the fifth grid $G_5$ and then a conductive layer 17 is formed. Then, a leveling drying is carried out for making the electrodes 8 to 10 and the conductive layer 17 flat from each other (the step (6) in FIG. 7).

Figure 8E:
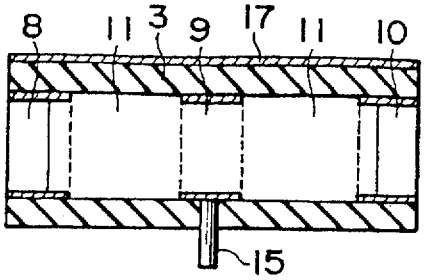

Then, as shown in FIG. 8E, a resistive layer 11 is coated and formed over a substantial entire inner surface of the resistive cylindrical device 3, i.e. with the portions having electrodes 8 and 10 at both ends of the resistive cylindrical device 3 being slightly left (the step (7) in FIG. 8). In this case, as theresistive paste, $RuO_2$-glass paste (a product name #9518 manufactured by Dupont), for example, is used and then the coating is carried out in such a way that the film thickness may become uniform.

Figure 10:
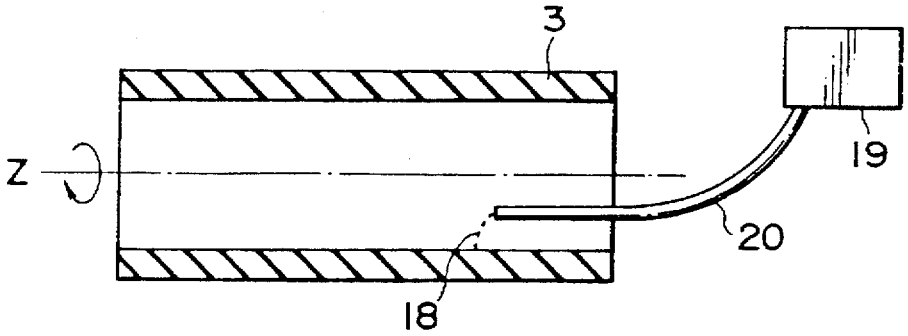
FIG. 10 is an illustrative view for showing an example of a method for coating resistive paste in the preferred embodiment.

FIG. 10 shows an example of a method for coating the resistive paste. As shown in this figure, the resistive cylindrical device 3 is rotated around a Z-axis, i.e. an axis direction of the tube so as to supply a specified amount of resistive paste 18 at the inner surface of the resistive cylindrical device 3 from a nozzle 20 connected to a tank 19 for the resistive paste 18.

Figure 11:
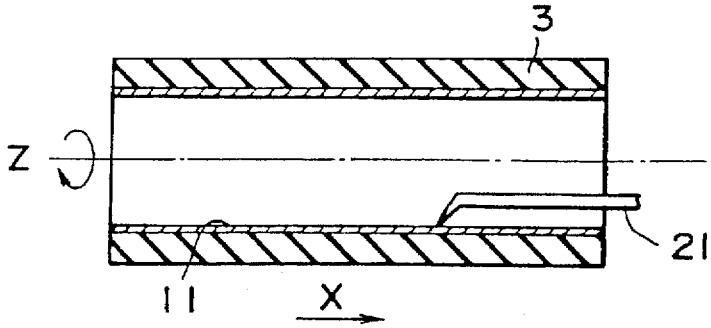
FIG. 11 is an illustrative view for showing an example of a method for trimming a resistive layer in the preferred embodiment.

Then, after the leveling drying for the resistive layer 11 is carried out (the step (8) in FIG. 7), both trimming and cleaning are performed for the resistive layer by the method shown in FIG. 11 (the step (9) in FIG. 7).

Figure 8F:
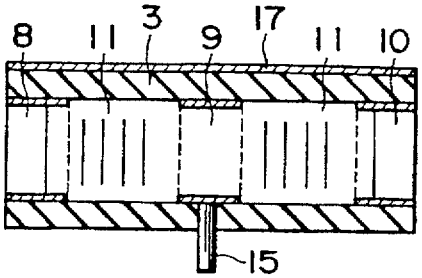

FIG. 11 shows one example of the trimming method. That is, the resistive cylindrical device 3 is moved in a direction of the X-axis while the resistive cylindrical device 3 is being rotated around the Z-axis, the extremity end of a marking-off needle 21 is contacted with the surface of the resistive layer 11, thereby the resistive layer 11 is marked off in a helical shape. In this case, only the portion not overlapped with the electrodes 8 to 10 is marked off. Through this step, the resistive layer 11 is formed in a helical shape between the electrodes 8, 9 and between the electrodes 9, 10, respectively (FIG. 8F). Cut dusts generated by the trimming operation are completely removed from the resistive cylindrical device by air blowing operation and the like (cleaning). Alternatively, the marking-off needle 21 may be moved.

Figure 12:
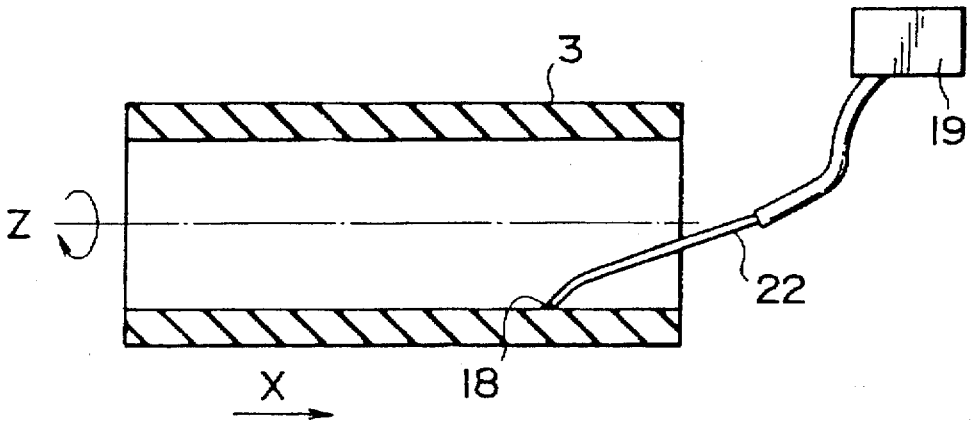
FIG. 12 is an illustrative view for showing an example of forming a helical state resistive layer in the preferred embodiment.

In turn, the resistive layer 11 may be formed in a helical shape not by such a method as described above, but by the following method. That is, after performing the leveling drying at the step (6) in FIG. 7, the resistive cylindrical device 3 is moved in a direction of X-axis while being rotated around the Z-axis as shown in FIG. 12, and the resistive paste 18 can be supplied from a dispenser 22 (a hypodermic needle) connected to the tank 19 for the resistive paste 18.

In this case, it is preferable that a distance between the dispenser 22 and the resistive cylindrical device 3 is kept constant. In addition, alternatively, the dispenser 22 may be moved.

After the helical resistive layer 11 is formed by the aforesaid step, the resistive cylindrical device 3 is baked for ten minutes at a temperature of 850° C., for example (the step (10) in FIG. 7). With such an arrangement as above, the electrodes 8 to 10 and the resistive layer 11 are melted, fixed to the resistive cylindrical device 3 and stabilized.

Figure 8G:
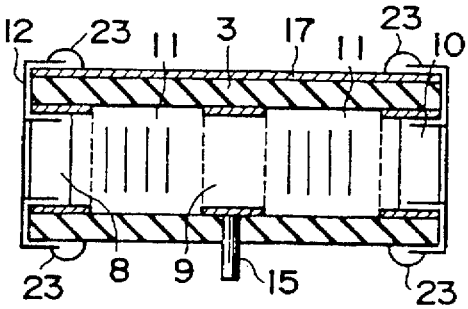

Then, after the resistive cylindrical device 3 is cleaned and dried (at the step (11) in FIG. 7), the resistive cylindrical device 3 is centered by a position setting jig and vertically set, the cylindrical holder 12 is set at the resistive cylindrical device 3 (the step (12) in FIG. 7), a flit 23 is arranged at a connected part between the cylindrical holder 12 and the resistive cylindrical device 3 as shown in FIG. 8G so as to perform a baking operation (the step (13) in FIG. 7).

After this operation, both the HV shield 4 and the HV spring 5 are assembled by applying the position setting jig and welded in respect to one cylindrical holder 12*a*. In addition, the triodes (cathode K, the first grid $G_1$, the second grid $G_2$ and the cup member $G3_A$) assembled in advance by a well-known beading method are assembled by the position setting jig and welded against the other cylindrical holder 12*b* (the step (14) in FIG. 7).

In addition, the lead lines 24, 25 of the first and second grids $G_1$, $G_2$ and the lead line 26 of the $G_4$ pin 15 are connected to the stem pin 6 buried in the stem 2, thereby an electron gun shown in FIG. 1 is completed.

In the preferred embodiment having such a configuration as described above, since the electrodes 8 to 10 corresponding to the third to fifth grids $G_3$ to $G_5$ forming the main lens are formed into a high precision and integral-formed resistive cylindrical device 3, an axial displacement of these electrodes 8 to 10 in respect to the Z-axis is reduced. Accordingly, in accordance with the preferred embodiment of the present invention, it is possible to restrict some electron beams moved away from the axis.

In addition, in the preferred embodiment of the present invention, since the helical resistive layer 11 is formed among the electrodes 8 to 10, a potential gradient among the electrodes 8 to 10 (an electric field intensity variation rate) is reduced as compared with that of the related art, resulting in that an electrical discharging is hardly generated among the electrodes 8 to 11. In addition, since the spherical aberration is reduced, it is possible to reduce the beam spot diameter and further to improve a resolution.

In the aforesaid preferred embodiment, although the electrodes 8 and 10 are connected through the conductive layer 17 and the cylindrical holders 12*a*, 12*b*, the present invention is not limited to this arrangement and it may also be applicable that the cylindrical holders 12*a*, 12*b* are connected by lead lines.

Figure 13:
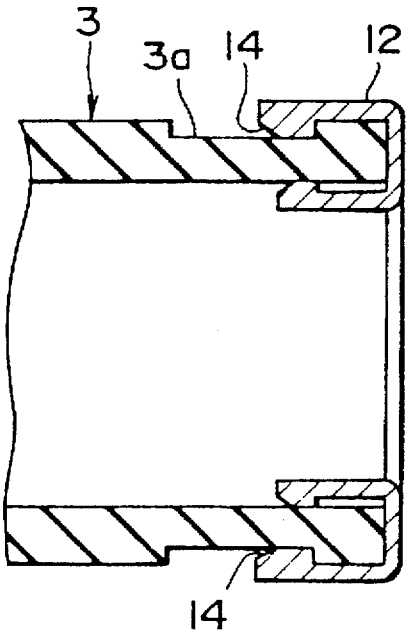
FIG. 13 is a sectional view for showing another example of a method for fixing a cylindrical holder in the preferred embodiment.

In addition, in the preferred embodiment described above, although the cylindrical holders 12*a*, 12*b* are fixed to the resistive cylindrical device 3 through the flit glass 23 as shown in FIG. 8G, for example, the present invention is not limited to this arrangement, and the present invention can be configured such that a concave part 3a is formed at the outer surface of the resistive cylindrical device 3 as shown in FIG. 13, for example, and the concave part 3a and the projection 14 of the cylindrical holder 12 are fitted to each other. In this case, it is satisfactory that the HV shield 4 and the cylindrical holder 12 are welded in advance. In addition, the HV shield 4 and the HV spring 5 may not be welded but fitted to each other to fix from each other. In addition, in the present invention, the number of projections 14 formed at the cylindrical holder 12 is not limited to that described in the aforesaid preferred embodiment, but any optional number of a plurality of projections can be selected.

In addition, in the preferred embodiment described above, although only the first grid $G_1$, the second grid $G_2$ and the third grid $G3_A$ are fixed by the beading glass 7, the present invention is not limited to this arrangement and it is possible to extend the beading glass 7, for example, and to fix the HV shield 4 together with it. With such an arrangement as above, it is possible to assemble the electron gun more rigidly. In this case, the fixing with the beading glass is carried out at the last stage of the assembling operation of the electron gun.

In addition, the present invention is not limited to the aforesaid preferred embodiment, but it may be changed into various modifications. For example, in the present invention, the aforesaid resistive layer 11 is not necessarily required. In addition, the first electrode, the third electrode and the second electrode arranged within the resistive cylindrical device 3 acting as the resistive member are not limited to the third grid $G_3$, the fourth grid $G_4$ and the fifth grid $G_5$, but they may be of other grids.

Then, the electron gun of the cathode ray tube of the present invention will be described in detail in reference to the preferred embodiments shown in the drawings as follows. The gap ratio between the electrodes is similar to that described in the aforesaid preferred embodiment.

Figure 14:
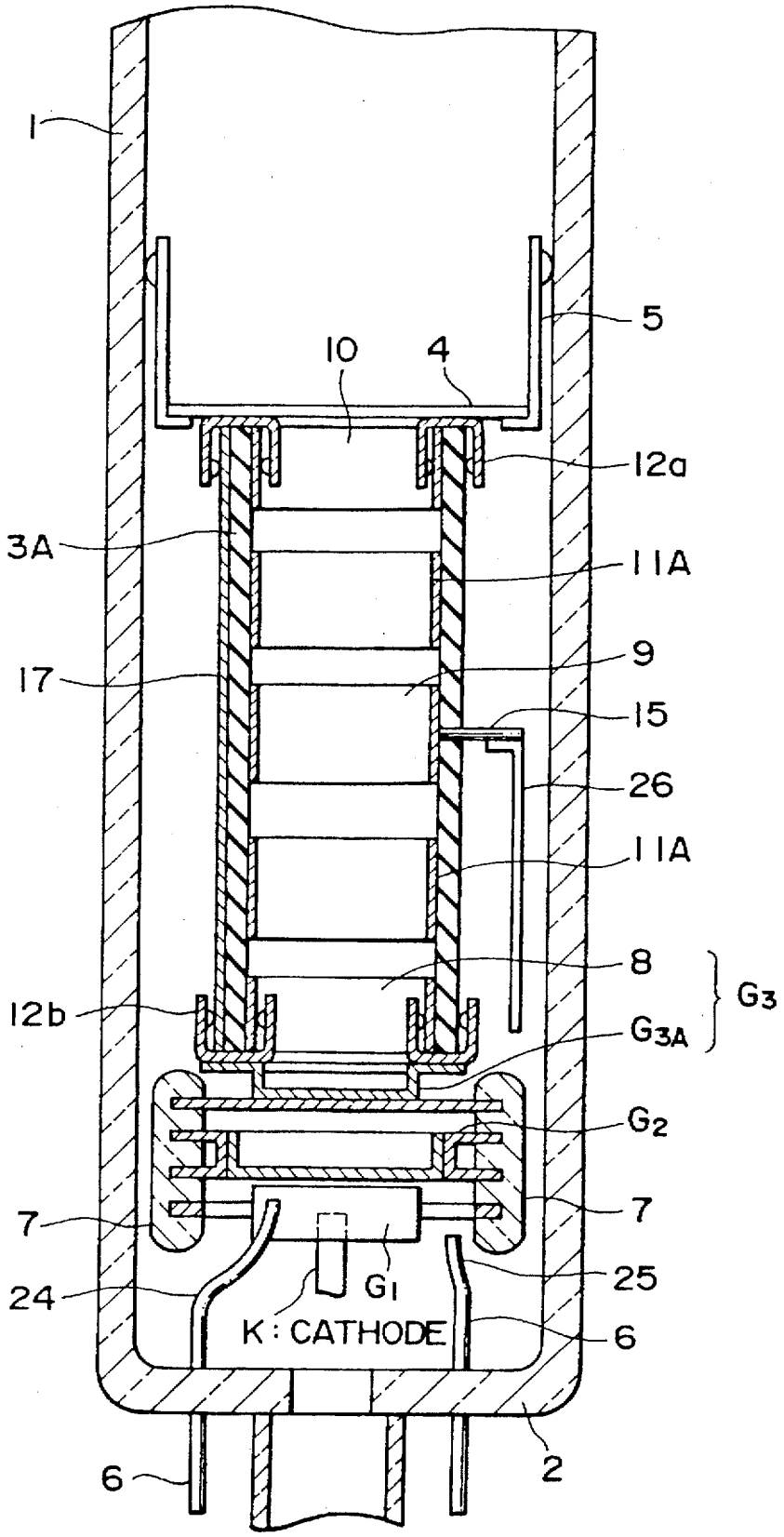
FIG. 14 is a sectional view for showing an entire configuration of an electron gun for a cathode ray tube in the preferred embodiment of the present invention.

In FIG. 14 is illustrated an entire configuration of the first preferred embodiment. The electron gun of the preferred embodiment of the present invention is of a uni-potential type. As shown in this figure, in the preferred embodiment, a cathode K for radiating electrons is arranged near a stem 2 of a neck tube 1, and then the first grid $G_1$, the second grid $G_2$ and a cup member $G3_A$ forming the third grid $G_3$ are arranged coaxially near the cathode K. Then, a resistive cylindrical device 3A to be described later for use in forming a main lens is arranged at a position adjacent to the cup member $G3_A$. In addition, the HV shield 4 and the HV spring 5 are fixed at the upper end of this resistive cylindrical device 3A. A plurality of stem pins 6 are buried in the stem 2.

The resistive cylindrical device 3A is made of conductive substance formed by mixing oxidized materials such as Ti, W, Cu in alumina ($Al_2O_3$), for example, and baking them or made of ferrite, titania ceramics and the like and its major substance is insulating material having a high anti-voltage characteristics.

This resistive cylindrical device 3A is formed into a cylindrical shape having a high degree of true circle (for example, 20 μm or less) and ring-like electrodes 8, 9 and 10 made of $RuO_2$-glass paste, for example, are coated on and formed at its both ends and the inner surface of the central part. In this case, the electrode 8 forms the third grid $G_3$ together with the cup member $G3_A$, and each of the electrodes 9, 10 may act as the fourth grid $G_4$ and the fifth grid $G_5$. A high voltage of about 30K to 32 KV is applied to the third grid $G_3$ (the first electrode) and the fifth grid $G_5$ (second electrode) and a middle voltage of about 7K to 10 KV is applied to the fourth grid $G_4$ (the third electrode).

Conductive layers 11A made of the same material as that of the electrodes 8 to 10 are formed among the electrodes 8, 9 and 10. In this case, the electrodes 8 to 10 and the conductive layer 11A are formed in a longitudinal direction of the resistive cylindrical device 3, i.e. a direction perpendicular to a Z-axis.

It is preferable that a resistance value of the resistive cylindrical device 3A is set to be 100 MΩ to 10 TΩ between each of the electrodes 8, 9 and each of the electrodes 9, 10 and more preferably it is about 1 GΩ under an assumption that the diameter of the resistive cylindrical device 3A and a space between the electrodes 8, 9 and between the electrodes 9, 10 are set to be about 12 mm, respectively. If the resistance is smaller than this value, it may easily generate heat and in turn if the resistance is larger than this value, it may easily produce a charged state. In the case that such a resistance value is set to be 1 GΩ, a volumetric resistivity of the resistive cylindrical device 3A becomes $10^8$ Ω·cm.

In addition, a conductive layer 17 extending in a longitudinal direction is formed at one outer surface of the resistive cylindrical device 3A.

Cylindrical holders 12 (12a, 12b) for use in electrically connecting the electrodes 8, 10 are fixed to both ends of the resistive cylindrical device 3A. The cylindrical holders 12 are made of metal such as stainless steel, for example, and as shown in FIGS. 2A to 2D, the holder has a ring-shaped flange part 13 fitted to the resistive cylindrical device 3. Opposing pairs of projections 14 are arranged at three locations at the inner circumference of this flange 13, and the inside projections of these projections 14 are contacted with the electrodes 10, 12 formed at the inner surface of the resistive cylindrical device 3. The cylindrical holder 12a and the cylindrical holder 12b are electrically connected through the conductive layer 17 formed at the outer surface of the resistive cylindrical device 3.

As shown in FIG. 14, a $G_4$ pin 15 is arranged at a substantial central part of the resistive cylindrical device 3. It is preferable that this $G_4$ pin 15 is made of cobalt (Co) iron or Ti alloy having a coefficient of expansion which is approximately equal to a coefficient of expansion of the resistive cylindrical device 3. Then, this $G_4$ pin 15 is fixed to be contacted with the electrode 9 through the hole 16 formed in the resistive cylindrical device 3. A lead line 26 is connected to the $G_4$ pin 15. This lead line 26, although not shown, is connected with and fixed to the stem pin 6.

Figure 3:
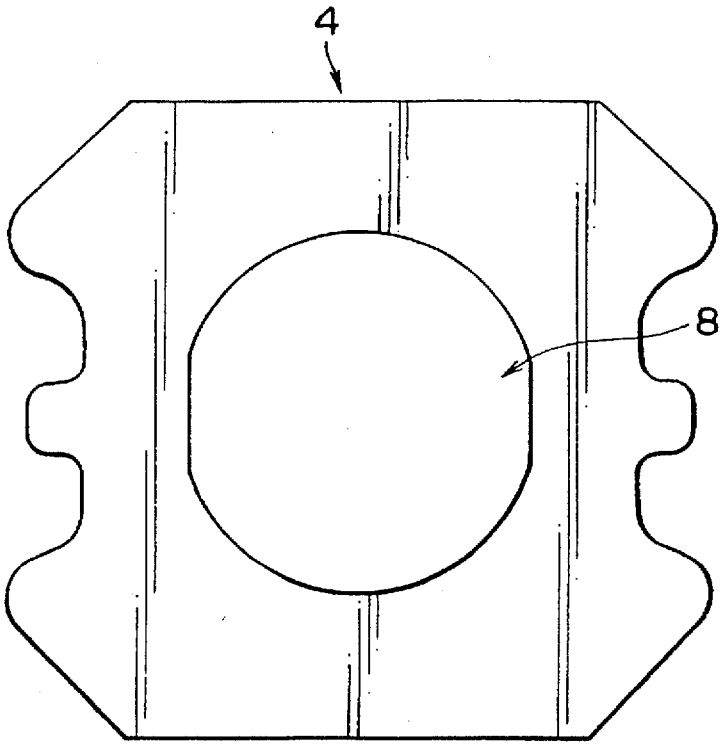
FIG. 3 is a top plan view for showing an HV shield of the preferred embodiment.

As shown in FIG. 3, the HV shield 4 is a flat plate-like member made of SUS304, for example, and there is provided a hole 8 at its central part for use in transmitting electron beams therethrough. As shown in FIG. 1, this HV shield 4 is fixed to the cylindrical holder 12a by welding.

The HV spring 5 is made of Inconell, for example. As shown in FIG. 1, the HV spring 5 is fixed to both ends of the HV shield 4 by welding and its extremity end presses the inner surface of the neck tube 1. This KV spring S is electrically connected to an anode button (not shown) through a conductive layer made of carbon and the like.

Figure 18A:
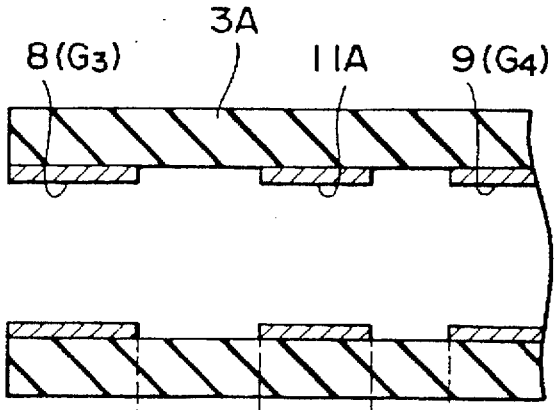
FIG. 18A is a sectional view for showing a substantial part of an electron gun of one preferred embodiment of the present invention.
Figure 18B:
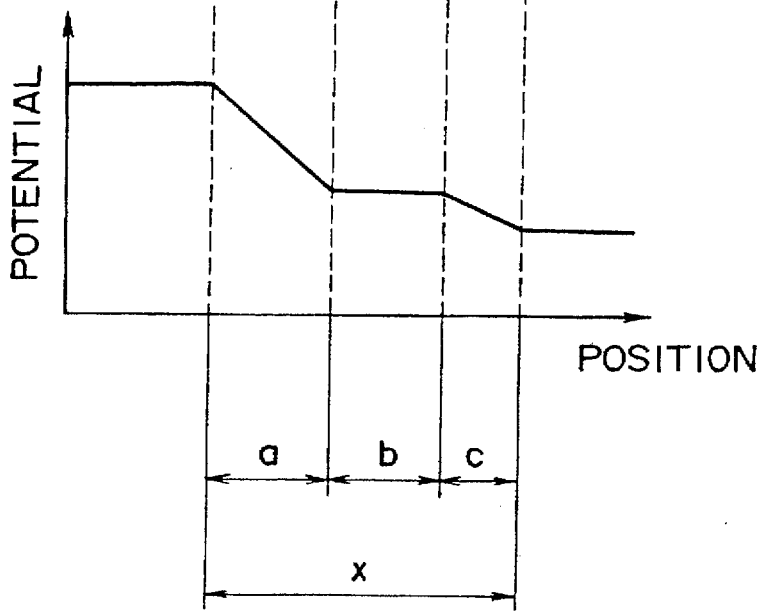
FIG. 18B is a graph for indicating a potential gradient.

In this preferred embodiment, as shown in FIG. 18A, a conductive layer 11A is arranged between the third grid $G_3$ (the first electrode) and the fourth grid $G_4$ (the third electrode) formed by the electrode 9 and a potential gradient between the grids becomes one as shown in FIG. 18B. A gap X between the electrode 8 and the electrode 9 is about 10 to 20 mm in the preferred embodiment. Although the gap between the electrode 9 and the electrode 10 shown in FIG. 14 is not specifically restricted, but in the case that the gap X is defined as 1, it is 1 or more, preferably 1 to 3 and more preferably 1 to 2. Under such a setting as above, it is confirmed that a coefficient of spherical aberration can be made further small.

In the preferred embodiment, the conductive layer 11A is arranged near the electrode 9 constituting the third electrode, a ratio of a:b:c indicating a positional relation of the arrangement of the conductive layer 11A is preferably 1 to 2:2 to 4:8 to 10.

Figure 4:
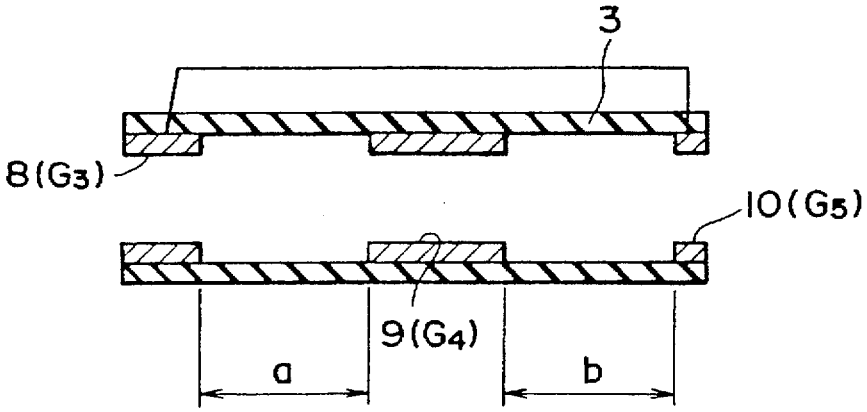
FIG. 4 is a conceptional view for showing a gap between the electrodes.
Figure 19A:
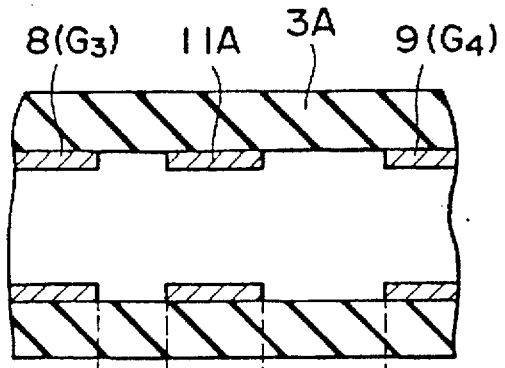
FIG. 19A a sectional view for showing a substantial part of an electron gun of another preferred embodiment of the present invention.
Figure 19B:
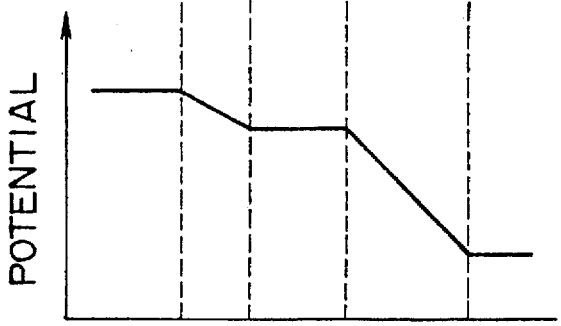
FIG. 19B is a graph for indicating a potential gradient.
Figure 19C:
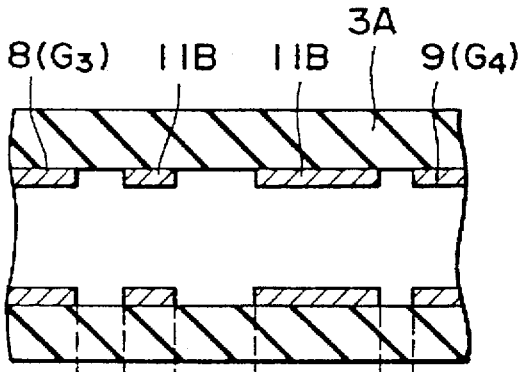
FIG. 19C is a sectional view for showing a substantial part of an electron gun of a still another preferred embodiment of the present invention.
Figure 19D:
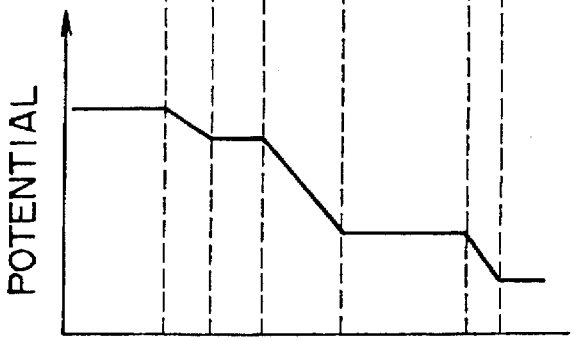
FIG. 19D is a graph for indicating a potential gradient.

The arranging position of the conductive layer 11A is not limited to the preferred embodiment shown in FIG. 4, but the conductive layer 11A can be arranged near the electrode 8 which is applied a high voltage as shown in FIG. 19A and further a plurality of conductive layers 11B can be arranged as shown in FIG. 19C. It is also possible to make an optional changing of a potential gradient as shown in FIGS. 19B and 19(D) by changing the arranging position and the number of arrangement of the conductive layers 11A, 11B, respectively.

In the preferred embodiment shown in FIG. 14, although the conductive layer 11A is also arranged between the electrode 9 acting as the third electrode and the electrode 10 acting as the high voltage electrode, the arranging position and the number of arrangement of the conductive layer 11A are not restricted in particular. In addition, in the present invention, one of the conductive layers 11A of the conductive layer 11A between the electrode 8 and the electrode 9 and the conductive layer 11A between the electrode 9 and the electrode 10 may not be necessarily arranged.

In the electron gun of the cathode ray tube in the preferred embodiment of the present invention, since the outer circumferences of the electrodes 8, 9 and 10 are arranged on the resistive cylindrical device 3A, there is no possibility that the electron beams are leaked out of a space between the electrodes and charged up at the beading glass. In addition, since the electron lens configuration part is formed by the resistive cylindrical device 3A, a displacement of a degree of concentricity in the electron lens system is scarcely produced.

In addition, in the present invention, the ring-shaped electrode films 8, 9 and 10 formed at the a inner circumference of the resistive cylindrical device 3A can make an optional setting of these gaps. Further, the conductive layer 11A is arranged among the ring-shaped electrodes 8, 9 and 10 to enable potential gradient between these electrodes to be optionally changed and then only the coefficient of spherical aberration Cs can be reduced without changing an amplification rate M.

Figure 17:
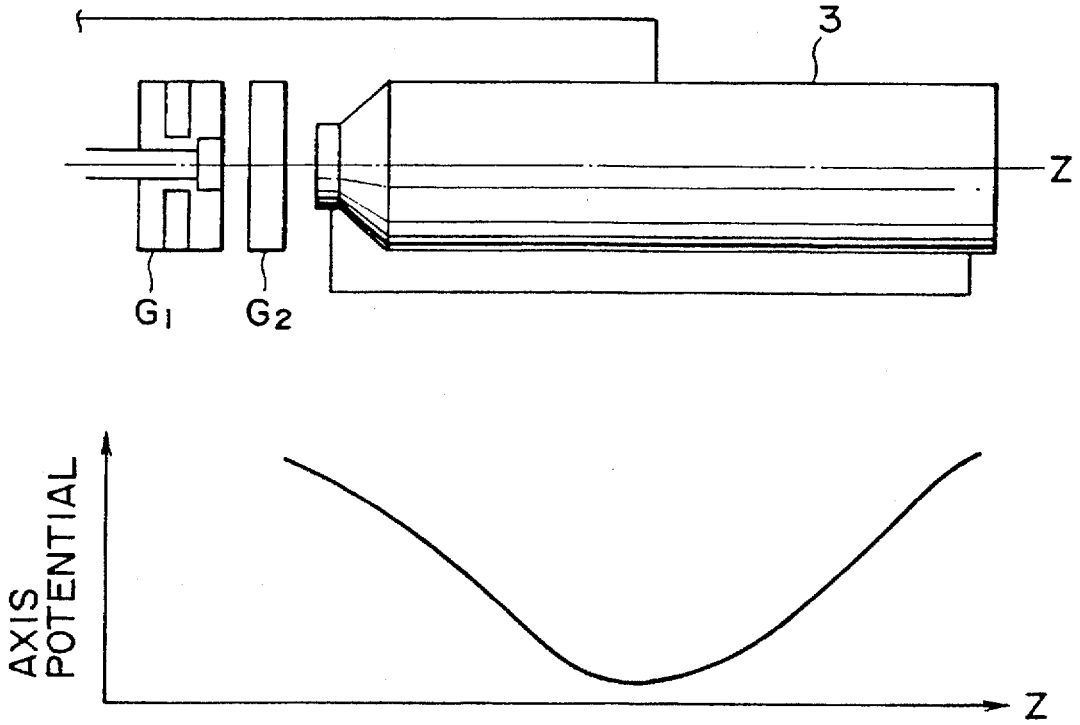
FIG. 17 is an illustrative view for showing a principle of an effect of the second preferred embodiment.

The coefficient of spherical aberration Cs may substantially influence over the spot diameter of the cathode ray tube. Accordingly, in the preferred embodiment of the present invention, the conductive layer 11A is arranged among the ring-shaped electrodes 8, 9 and 10 to cause a potential gradient among these electrodes to be optionally changed and further it becomes apparent from FIG. 17 that the coefficient of spherical aberration Cs can be reduced. As a result, the spot diameter is reduced and a resolution can be improved.

Figure 15:
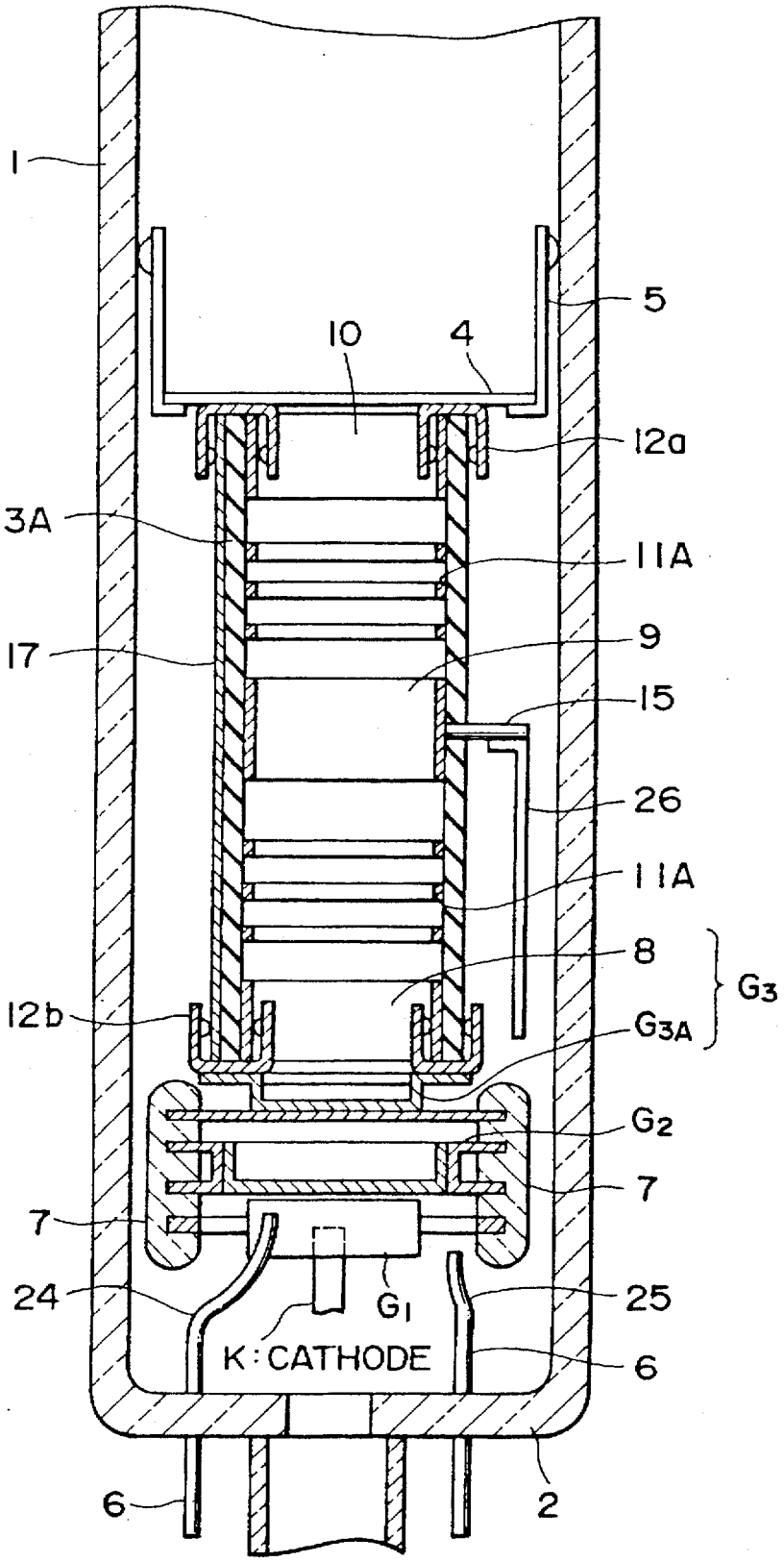
FIG. 15 is a sectional view for showing an entire configuration of an electron gun of the second preferred embodiment of the present invention.

FIG. 15 shows an example in which a plurality of conductive layers 11A are arranged among the electrodes 8 to 10.

Figure 16A:
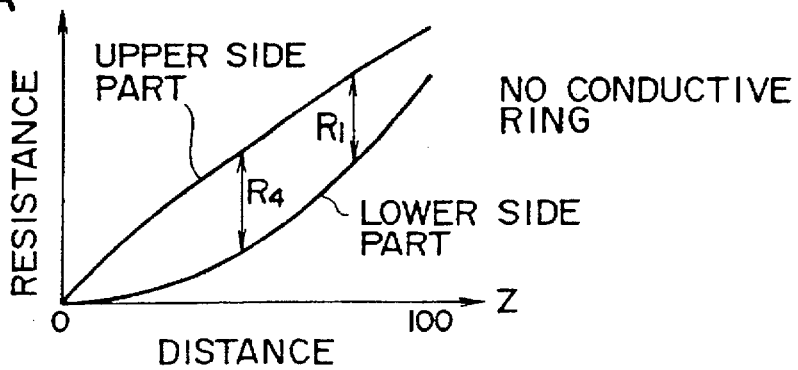
FIGS. 16A to 16D are graphs applied for describing an action of a conductive layer.
Figure 16B:
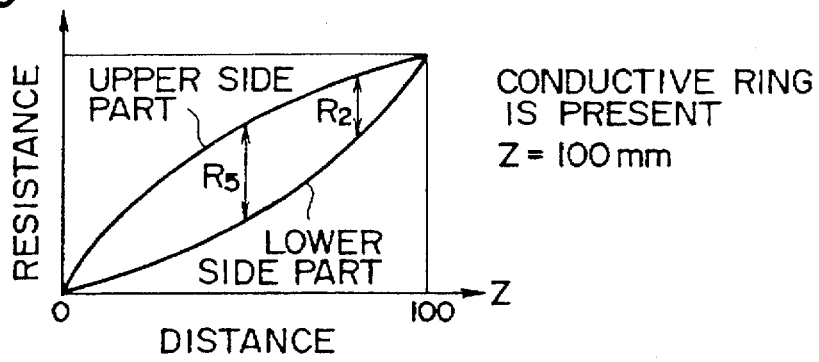
Figure 16C:
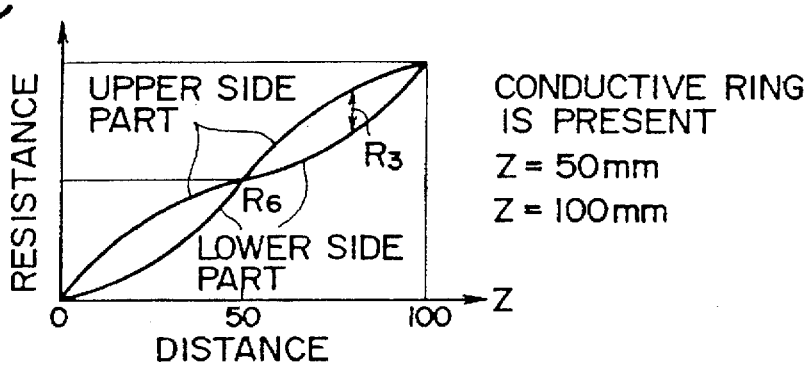
Figure 16D:
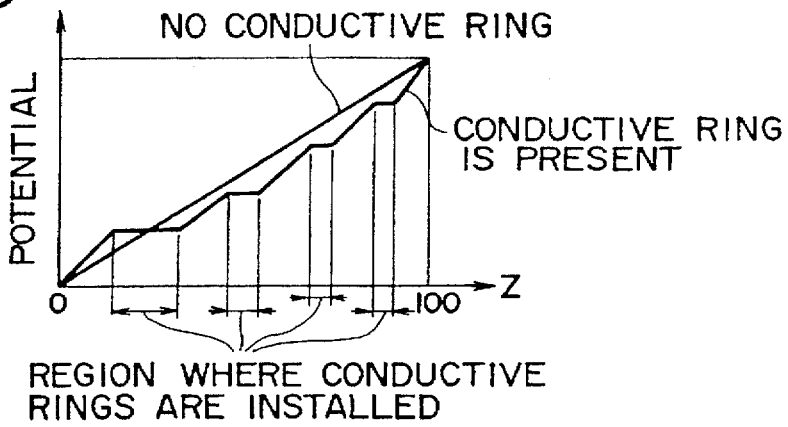

For example, as shown in FIG. 16B, in the case that the electrode 8 is arranged at the location of Z=0 mm and the conductive layer 11A is arranged at Z=100 mm, a value of disturbance in the aforesaid resistance among the electrodes 8 to 10 and the conductive layer 11A becomes low in the case that the conductive layer 11A is arranged ($R_1>R_2$, $R_4>R_5$). In the case that the conductive layer 11A is also arranged at the location of Z=50 mm, as shown in FIG. 16C, the value of disturbance in the aforesaid resistance becomes low ($R_2>R_3$, $R_5>R_6=0$).

Figure 2A:
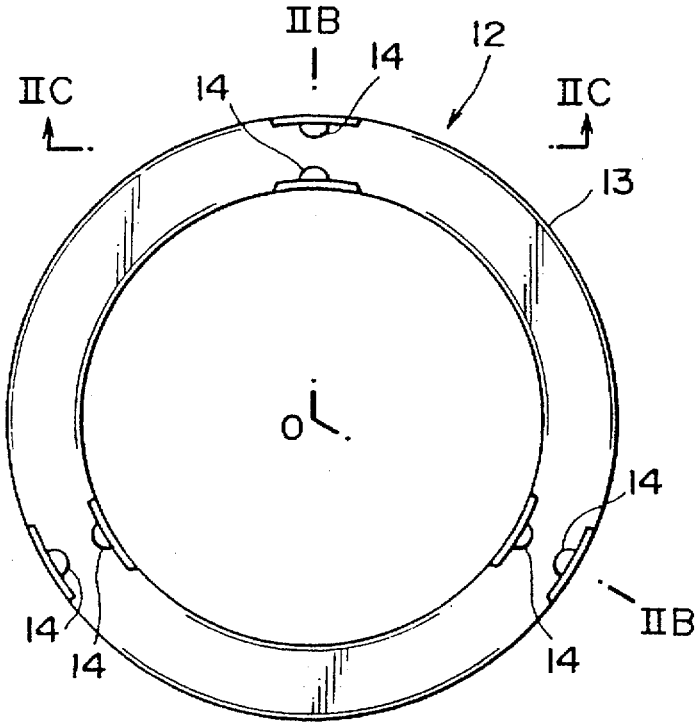
FIG. 2A is a front elevational view for showing a cylindrical holder of the first preferred embodiment.
Figure 2B:
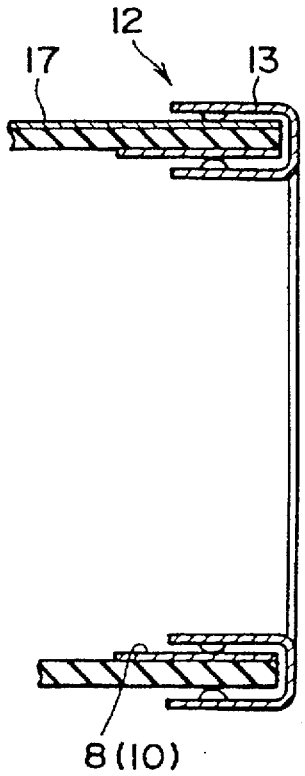
FIG. 2B is a sectional view taken along a line a-0-a– of FIG. 2A.
Figure 2C:
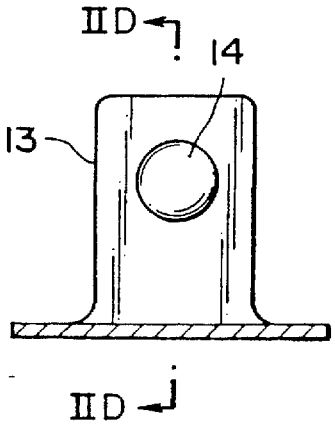
FIG. 2C is a sectional view taken along a line b-b' of FIG. 2A.
Figure 2D:
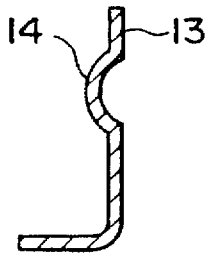
FIG. 2D is a sectional view taken along a line c-c' of FIG. 2C.

Referring now to FIGS. 7 and 2D, the method for manufacturing the electron gun of the preferred embodiment shown in FIG. 14 will be described.

Figure 20A:
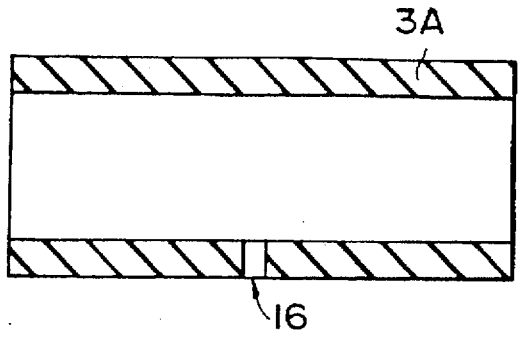
FIGS. 20A to 20D are illustrative views for indicating manufacturing steps in the preferred embodiment.

At first, the hole 16 for fixing the $G_4$ pin 15 is formed at the resistive cylindrical device 3A (the step (1) in FIG. 7 and FIG. 20A), the resistive cylindrical device 3A is cleaned and dried (the step (2) in FIG. 7).

Figure 20B:
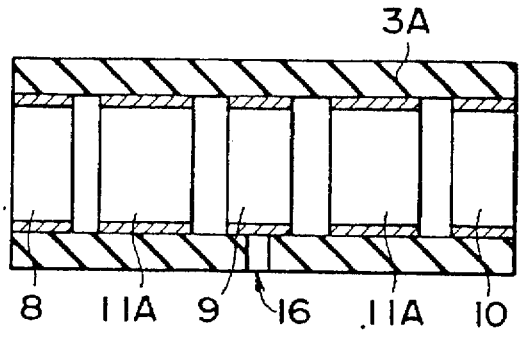
Figure 20C:
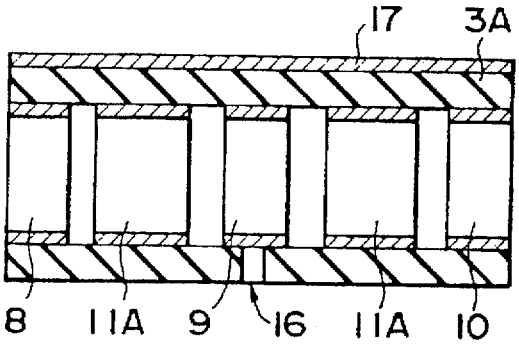

Then, the electrodes 8 to 10 and the conductive layer 11A are coated and formed at the inner surface of the resistive cylindrical device 3A (the step (3) in FIG. 7 and FIG. 20B). In this case, as the conductive paste, $RuO_2$-glass paste (a product name #9516 manufactured by Dupont and the like), for example, is applied and coated to have a uniform film thickness.

FIG. 21 shows the first example of the method for forming the electrodes 8 to 10 and the conductive layer 11A.

Figure 21A:
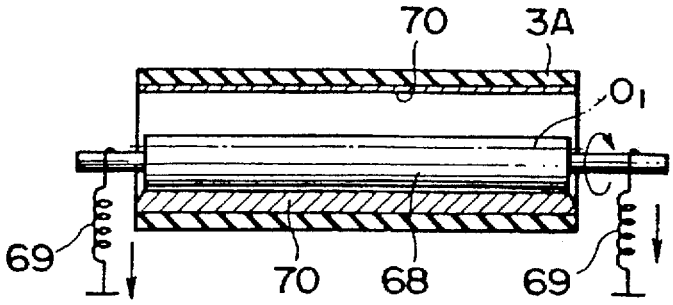
FIGS. 21A to 21C are illustrative views for showing the first example of a method for forming an electrode and a conductive layer.
Figure 21B:
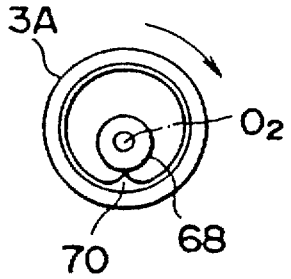

FIG. 21A shows a method for coating the conductive paste, wherein a rotatable rubber roller 68 having an approximate same height as that of the resistive cylindrical device 3A is installed within the resistive cylindrical device 3A, and the rubber roller 68 is pushed against the inner surface of the resistive cylindrical device 3A by a pair of springs 69. In this case, after a specified amount of conductive paste 70 is placed in a longitudinal direction of the rubber roller 68 as shown in FIG. 21B, it is set as shown in FIG. 21A and the resistive cylindrical device 3A is rotated around a rotating axis $O_1$. With such an arrangement as above, the rubber roller 68 is also rotated around the rotating axis $O_2$ and the conductive paste 70 is widely coated over the front inner surface of the resistive cylindrical device 3A. After this operation, the rubber roller 68 is pulled out of the resistive cylindrical device 3A and it is heated with hot air, for example, while the resistive cylindrical device 3A is being rotated and then dried. This operation is carried out for preventing the conductive paste 70 from being dripped.

Figure 21C:
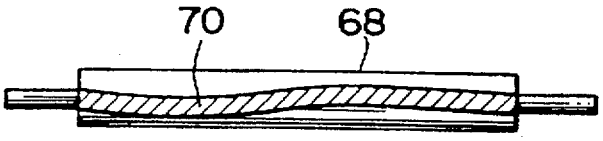
Figure 21D:
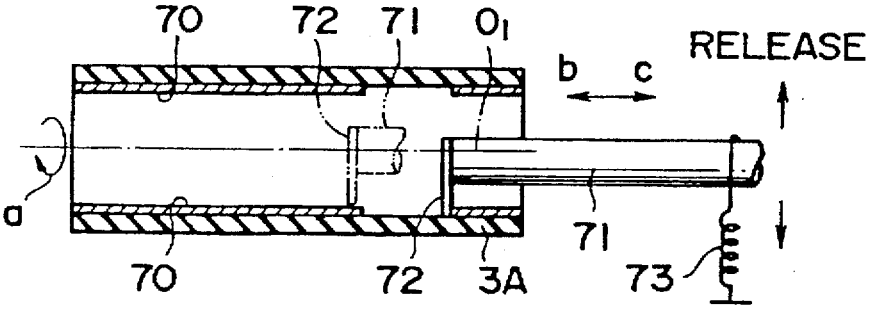
Figure 21E:
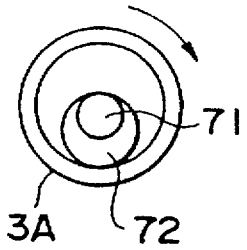

FIG. 21C shows a trimming method for the conductive paste 70. As shown in this figure, a marking-off disk 72 made of ultra-hard alloy is eccentrically attached to the extremity end of the supporting rod 71 and in turn this supporting rod 71 is pulled by the spring 73 in a direction crossing at a right angle with a longitudinal direction. Then, during the trimming step, the resistive cylindrical device 3A is rotated in a direction of an arrow (a) and the supporting rod 71 is arranged within the resistive cylindrical device 3A. When the supporting rod 71 is caused to be moved in either a direction (b) or a direction (c) and come to a position where the conductive paste 70 is not required, the spring 73 is operated to push the marking-off disk 72 against the conductive paste 70 so as to perform the trimming operation. In turn, as for the location where the conductive paste 70 is required, the spring 73 is released to cause the conductive paste 70 to be left. In addition, it may also be applicable that the conductive paste 70 is evaporated with heat generated after absorbing a laser beam so as to remove the paste.

FIG. 22 shows the second example of the method for forming the conductive layers 8 to 10 and the conductive layer 11A. This method is carried out with an exposing method using a negative type resist material (for example, PVA-ADC and the like).

Figure 22A:
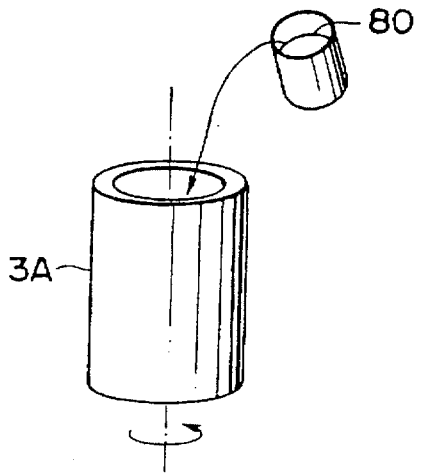
FIGS. 22A to 22D are illustrative views for showing the second example of a method for forming an electrode and a conductive layer.
Figure 22B:
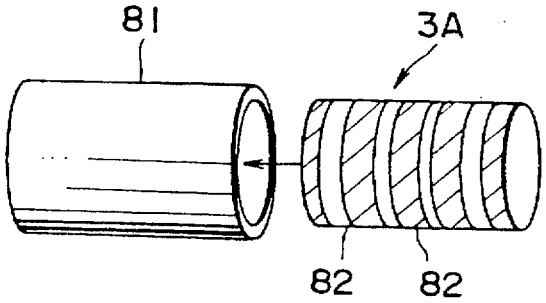

In the case that this method is carried out, at first, as shown in FIG. 22A, the resist material 80 is coated at the inner surface of the resistive cylindrical device 3A while the tube is being rotated. Then, as shown in FIG. 22B, a mask 81 is inserted into the resistive cylindrical device 3A and its position is aligned with that of the tube. This mask 81 is fabricated such that patterns 82 having the same patterns as those of the electrodes 8 to 10 and the conductive layer 11A are formed at an outer circumference of ultraviolet ray transmittance glass (for example, quartz) having an outer diameter equal to the inner diameter of the resistive cylindrical device 3A.

Figure 22C:
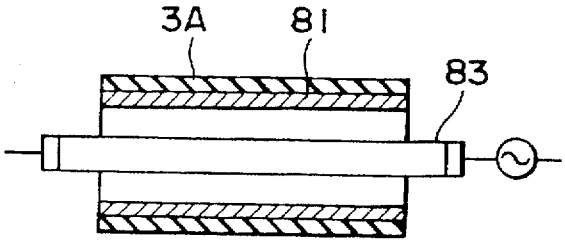
Figure 23A:
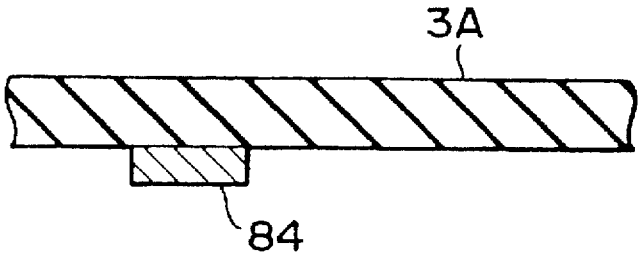
FIGS. 23A to 23C are illustrative views for showing the electrode and the conductive layer formed in accordance with the second example.

Then, as shown in FIG. 22C, the ultraviolet ray radiating lamp 83 is installed inside the mask 81 and an exposing operation is performed. Then, the mask 81 is removed from the resistive cylindrical device 3A, water is blown against it to perform a developing operation, resulting in that the electrode pattern of the resist 84 as shown in FIG. 23A is formed.

Figure 22D:
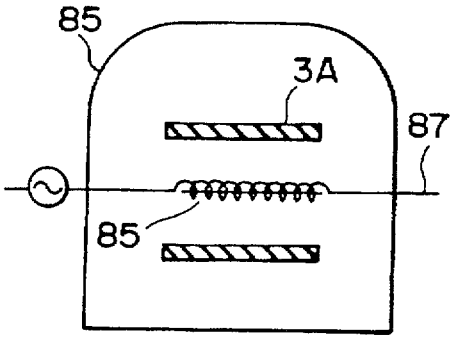
Figure 23B:
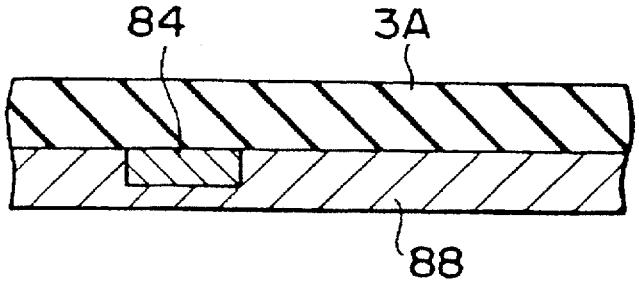
Figure 23C:
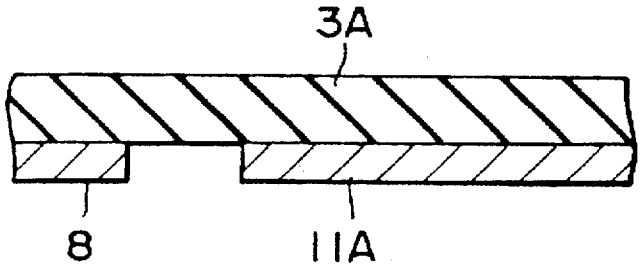

Then, as shown in FIG. 22D, the resistive cylindrical device 3A is arranged within a vacuum pump 85, a wire 86 made of metals such as Al, Au or the like is heated by a heater 87 and a metallic film 88 is vapor deposited at the inner surface of the resistive cylindrical device 3A (FIG. 23B). In addition, a reversing development with $H_2O_2$ and a baking (430° C., 30 minutes) are carried out and the electrodes 8 to 10 and the conductive layer 11A are formed as shown in FIG. 23C.

Figure 24:
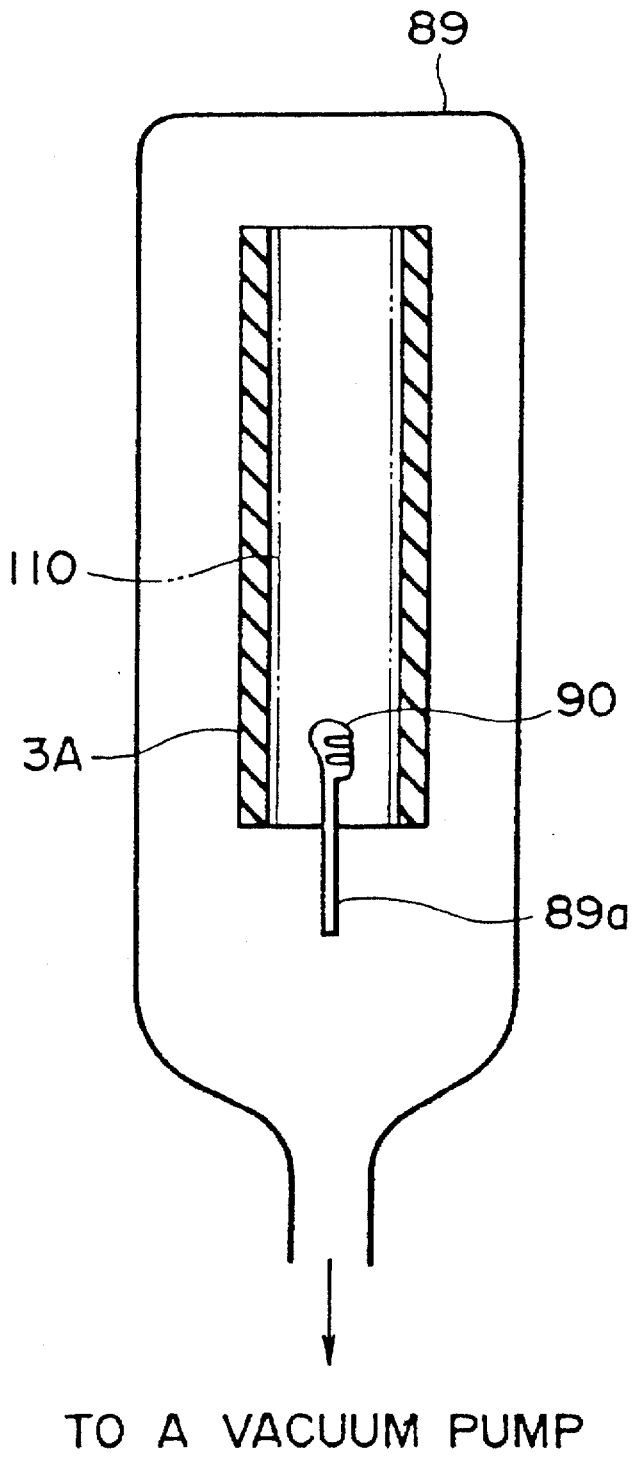
FIG. 24 is an illustrative view for showing the third example of a method for forming an electrode and a conductive layer.

FIG. 24 shows the third example of the method (a metal mask vapor depositing method) for forming the electrodes 8 to 10 and the conductive layer 11A. In this method, a metallic ring-like mask 110 is inserted in such a way that the mask is closely contacted with the inner surface of the resistive cylindrical device 3A, and this resistive cylindrical device 3A is arranged within a container 89 connected to a vacuum pump. Then, an inner area of the container 89 is changed into a vacuum state and at the same time the aforesaid vapor depositing metal 90 is heated by a heater 89*a* so as to vapor deposit the metal against the inner surface of the resistive cylindrical device 3A.

FIG. 25 shows the fourth example of the method for forming the electrodes 8 to 10 and the conductive layer 11A (a heat transfer method).

Figure 25A:
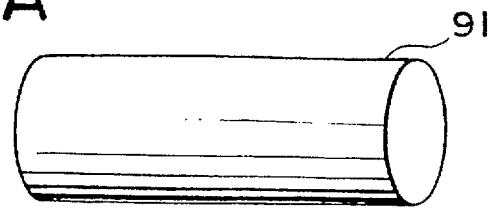
FIGS. 25A to 25E are illustrative views for showing the fourth example of a method for forming electrodes and conductive layers.
Figure 25B:
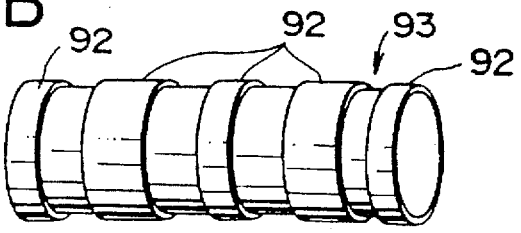
Figure 25C:
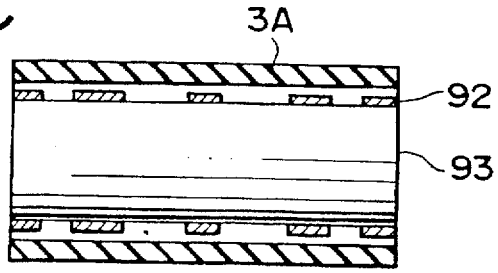
Figure 25D:
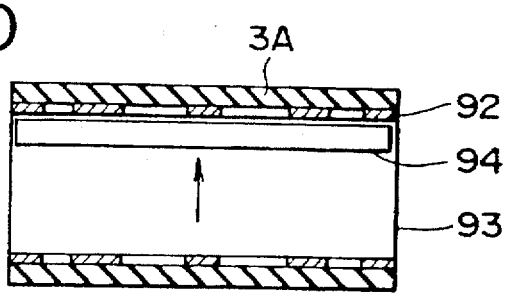
Figure 25E:
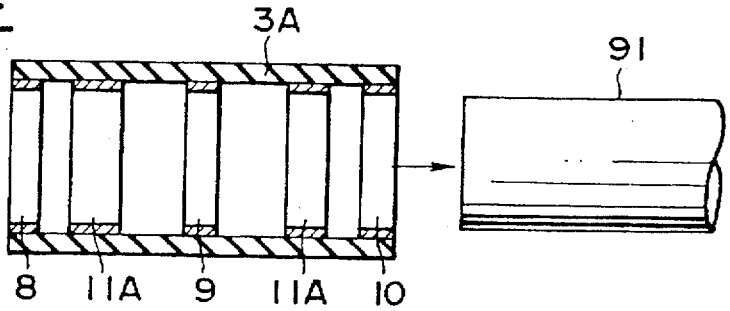

In this method, at first, a heat transfer base film 91 made of polyester is formed into a cylindrical shape (FIG. 25A). Each of a peeling-off layer (not shown), a conductive layer 92 and an adhering layer (not shown) is coated and formed in sequence on the base film 91 so as to complete the heat transfer sheet 93 (FIG. 25B). Then, as shown in FIG. 25C, a position of the heat transfer sheet 93 is set and the sheet is inserted into the resistive cylindrical device 3A. Then, the heat transfer sheet 93 is closely contacted with the inner surface of the resistive cylindrical device 3A, and both heating and pressurizing are carried out by a silicon roller 94 having a heater stored therein (FIG. 25D). With such an arrangement as above, the conductive layer 92 on the heat transfer sheet 93 is transferred to the inner surface of the resistive cylindrical device 3A so as to form the electrode layers 8 to 10 and the conductive layer 11A. After this operation, the base film 91 is peeled off and removed as shown in FIG. 13E.

Figure 26A:
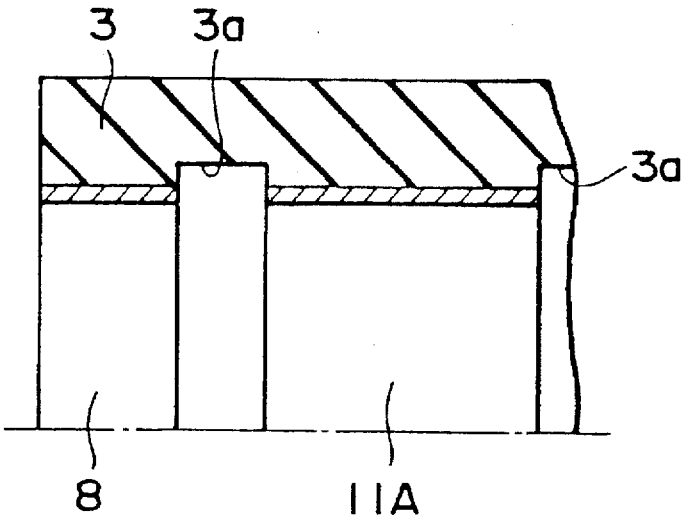
FIGS. 26A and 26B are illustrative views for showing the fifth example of a method for forming an electrode and a conductive layer.
Figure 26B:
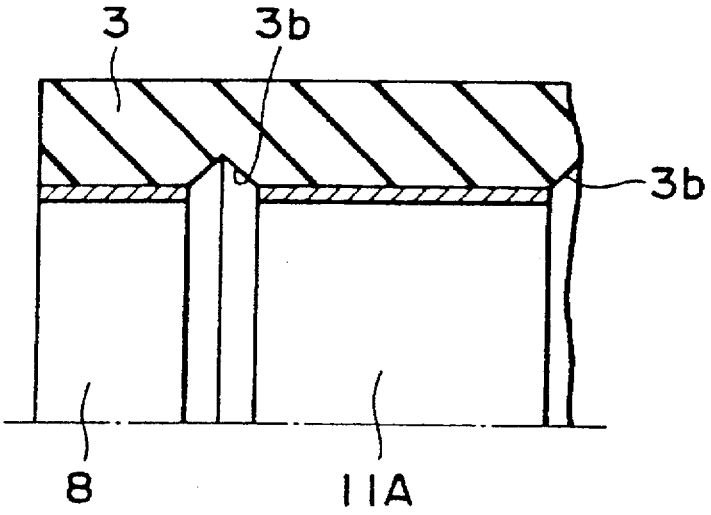

In addition, as shown in FIGS. 26A and 26B, concave portions 3*a* and 3*b* are formed in advance at the inner surface of the resistive cylindrical device 3A, and the conductive paste 70 is fully coated by applying a rubber roller 68 shown in FIG. 9 as described above, thereby it is also possible to form the electrodes 8 to 10 having a predetermined pattern and to form the conductive layer 11A.

Figure 27A:
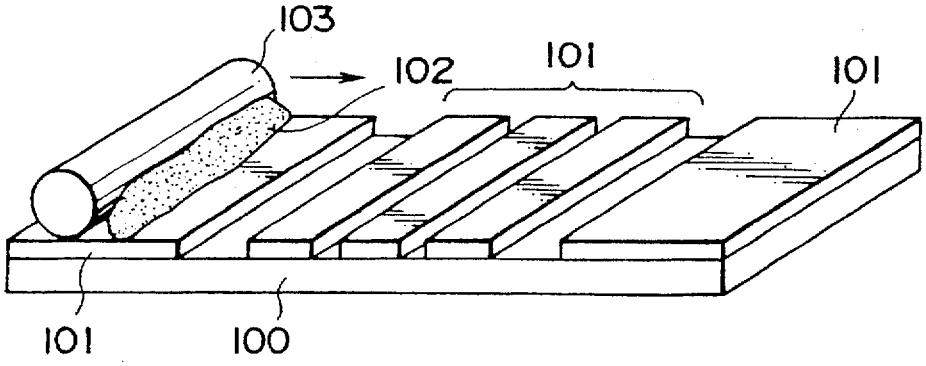
FIGS. 27A to 27C are sectional views for showing the sixth example of a method for forming electrodes and conductive layers.
Figure 27B:
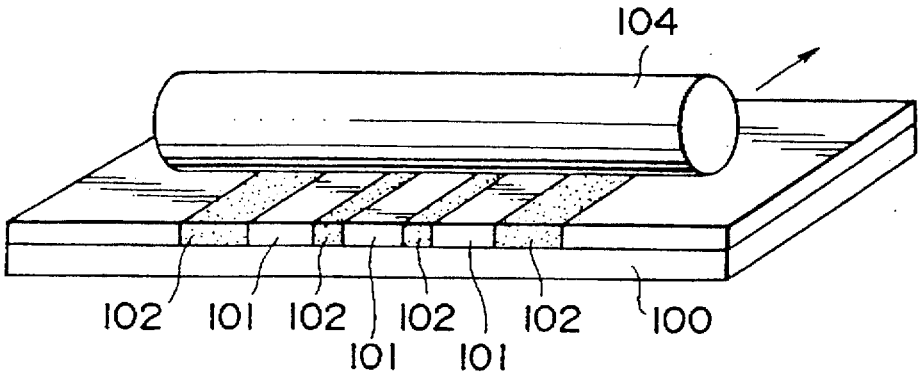
Figure 27C:
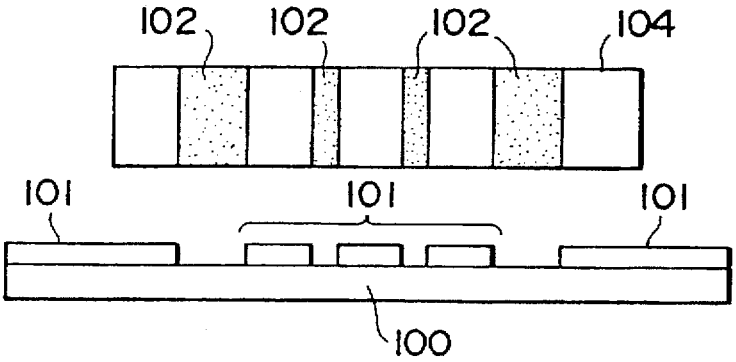
Figure 28A:
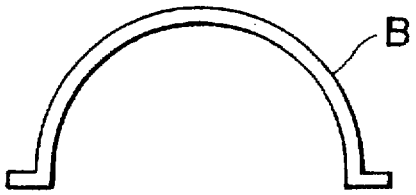
FIGS. 28A and 28B are illustrative views for showing another example of a method for fixing a resistive cylindrical device.
Figure 28B:
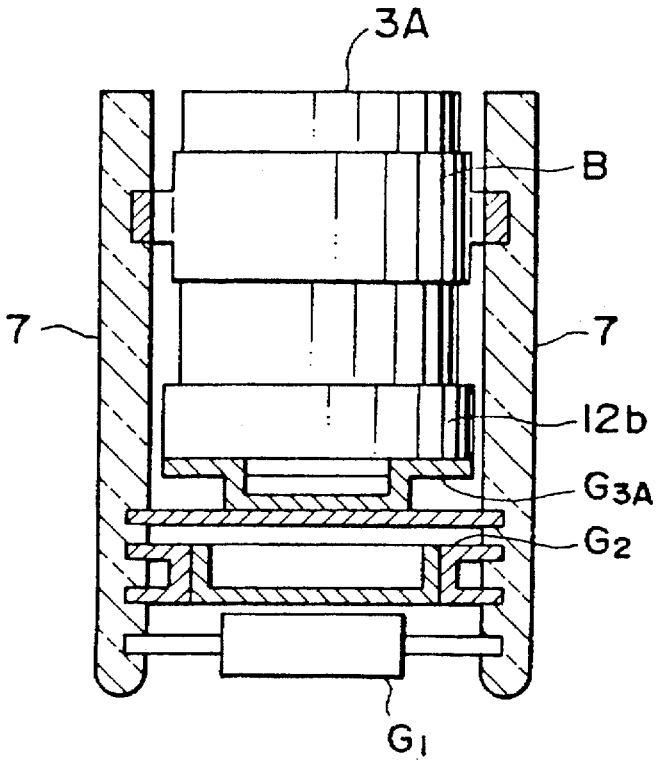

FIG. 27 shows the sixth example of the method for forming the electrodes 8 to 10 and the conductive layer 11A. At first, as shown in FIG. 15A, this example is operated such that the conductive paste 102 is placed at the end part of the base 100 having a predetermined pattern 101, the roller 103 is rolled in a direction crossing at a right angle with the pattern 101, for example, thereby the conductive paste 102 is filled in the concave part between the patterns 101.

Then, as shown in FIG. 27B, the same roller 104 as that used in the first example (refer to FIG. 21A) is rolled in a direction crossing at a right angle with the roller 103, thereby the conductive paste 102 is adhered to the roller 104 as shown in FIG. 15C.

In addition, as shown in FIG. 21A, the roller 104 is pressed against the inner surface of the resistive cylindrical device 3A in the same manner as that of the first example and the resistive cylindrical device 3A is rotated. With such an arrangement as above, the conductive paste 102 is adhered to the inner surface of the resistive cylindrical device 3A and the electrodes 8 to 10 and the conductive layer 11A are formed.

Additionally, it is also possible to form a predetermined pattern on the base by a screen printing system and to form the electrodes 8 to 10 and the conductive layer 11A at the inner surface of the resistive cylindrical device 3A in the same manner as that shown in FIGS. 27B, C and FIG. 21A as described below.

The aforesaid electrodes 8 to 10 and the conductive layer 11A can also be formed by blowing the conductive paste against the inner surface of the resistive cylindrical device 3A by an ink jet system.

In addition, the electrodes 8 to 10 and the conductive layer 11A in the preferred embodiment can also be formed by a method using a dispenser.

After forming of the electrodes 8 to 10 and the conductive layer 11A with the aforesaid method, a leveling drying is carried out to keep the film thickness uniform (step (4) in FIG. 7) and then they are baked in air for 10 minutes at a temperature of 850° C., for example, (step (5) in FIG. 7), and the electrodes 8 to 10 and the conductive layer 11A are fixed to the inner surface of the resistive cylindrical device 3A comprised of ceramics. In the case that third method (a metal mask vapor depositing method) of the method for forming the aforesaid electrodes 8 to 10 and the conductive layer 11A is applied, such a baking as described above can be eliminated.

After this operation, as shown in FIG. 20, the aforesaid conductive paste 70 is coated in a longitudinal direction of an outer circumference at a side where the $G_4$ pin of the resistive cylindrical device 3A is not provided in order to make an electrical connection between the electrode 8 acting as the third grid $G_3$ and the electrode 10 acting as the fifth grid $G_5$ and then the conductive layer 17 is formed.

Figure 20D:
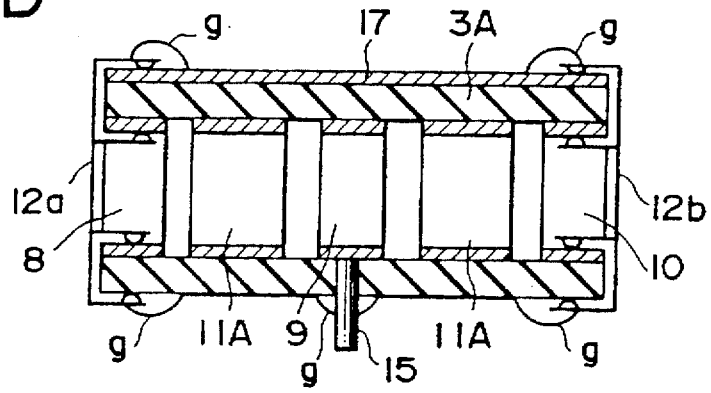

Then, the resistive cylindrical device 3A is centered with a position setting jig, the cylindrical holder 12 is set to the resistive cylindrical device 3A after being vertically set and at the same time, the $G_4$ pin 15 is attached to the hole 15 and fixed by a jig, a flit glass (g) is arranged as shown in FIG. 20D and then a baking is carried out for 10 minutes at a temperature of 850° C., for example (steps (6) and (7) in FIG. 7).

After forming the electrodes 8 to 10 and the conductive layer 11A, the leveling drying (step (4)) and the baking (step (5)) are not performed, but the cylindrical holder 12 and the $G_4$ pin 15 are set and the flit glass (g) is coated to enable the baking step (step (7)) to be carried out once.

After this operation, as shown in FIG. 14, the HV shield 10 and the HV spring 5 are assembled and welded by applying a position setting jig against one cylindrical holder 12*a*. The triodes (the cathode K, the first grid $G_1$, the second grid $G_2$, the cup member $G3_A$) assembled in advance by a well-known beading method in respect to the other cylindrical holder 12*b* are assembled and welded by applying the position setting jig (step (8) in FIG. 7).

In addition, the lead lines 24, 25 of the first and second grids $G_1$, $G_2$ and the lead line 16 of the $G_4$ pin 15 are connected to the stem pins 6 buried in the stem 2 so as to complete the electron gun as shown in FIG. 1 (step (9) in FIG. 7).

Figure 29A:
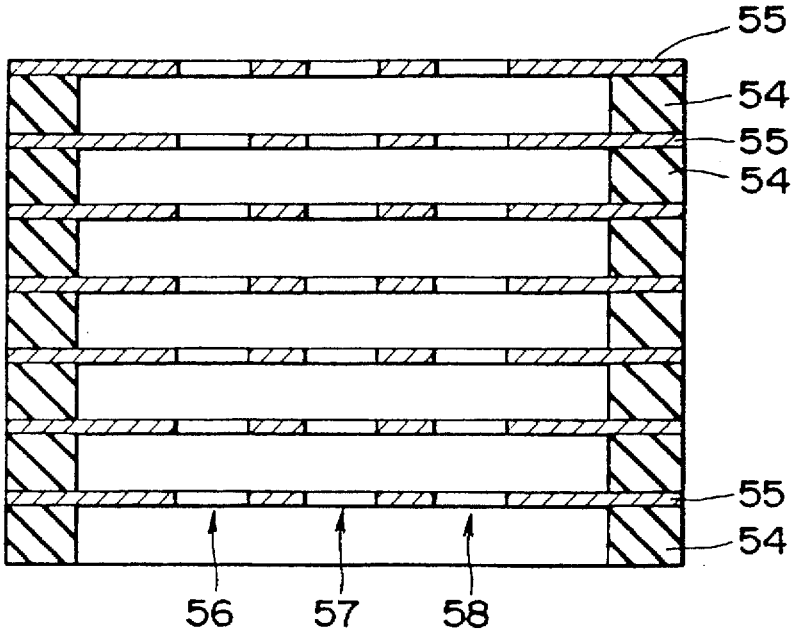
FIGS. 29A and 29B are a sectional view and a top plan view for showing a substantial part of the third preferred embodiment of the present invention, respectively.
Figure 29B:
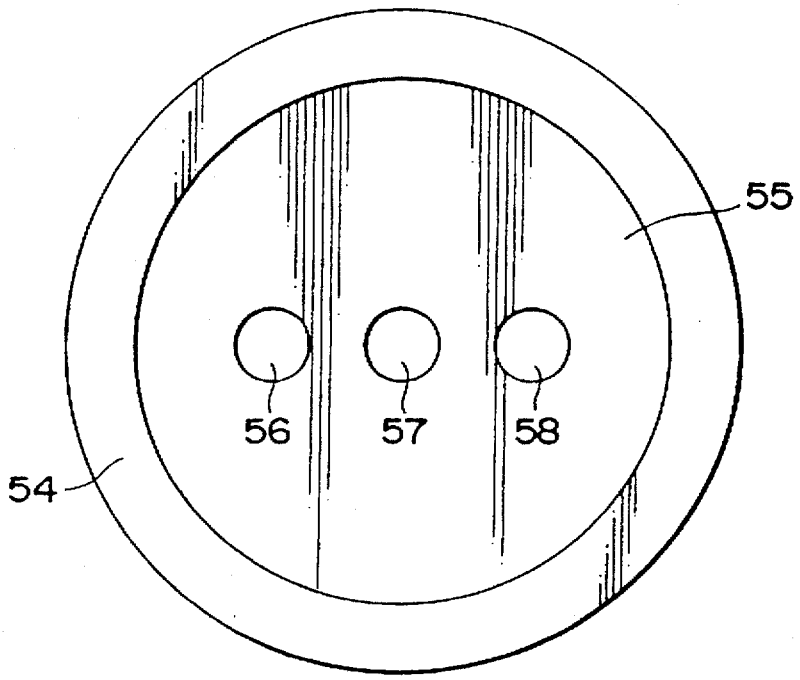

FIG. 29 shows a substantial part of the third preferred embodiment of the present invention. In this preferred embodiment, the ring-like members 54 made of high resistive ceramics which is similar to that described above are piled up, and some disk-like metallic plates 55 are held among the members 54. In this case, the metallic plates 55 are formed with some holes 56 to 58 for use in transmitting electron beams therethrough. This preferred embodiment relates to the case of the electron guns for producing three beams, although such a configuration as above can be applied to the electron gun for a single beam.

In the aforesaid preferred embodiment as above, when the electrodes 8 to 10 of the resistive cylindrical device 3A made of high resistance ceramics are formed, the conductive paste 70 is coated and dried, thereafter the paste 70 is required to bake, resulting in that there is a possibility that its cost is increased.

The conductive paste 70 comprised of $RuO_2$-glass paste is damaged during sparking, so that there is a possibility that a lens characteristic may be deteriorated.

In addition, it is necessary to make a more inclined resistance gradient distribution so as to improve a lens characteristic, although a uniform distribution of resistance within the resistive cylindrical device 3A causes this distribution to be restricted.

In view of this fact, the fourth preferred embodiment of the present invention has the following configuration.

Figure 30A:
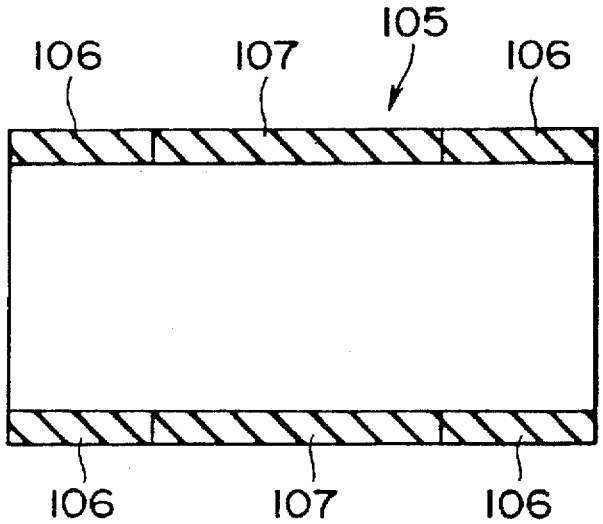
FIGS. 30A and 30B are sectional views for showing a substantial part of the fourth preferred embodiment of the present invention.
Figure 30B:
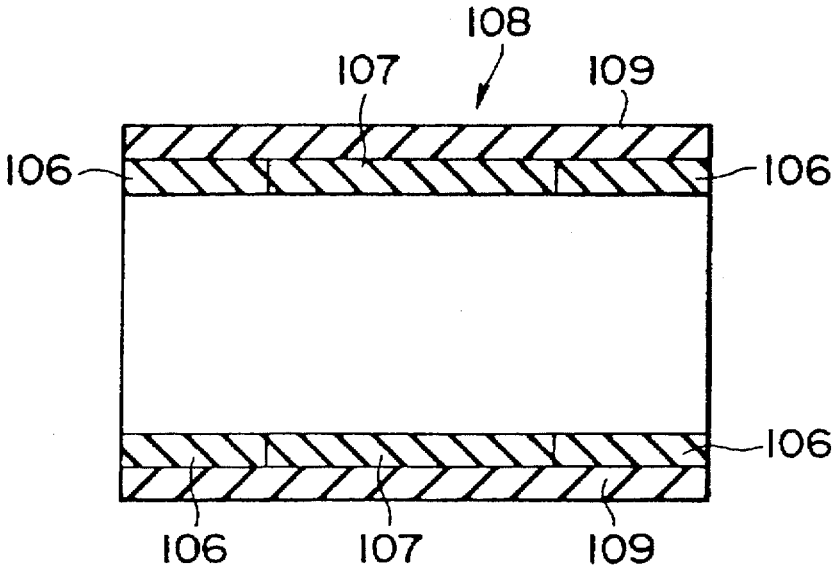

FIG. 30 shows a configuration of a substantial part of the preferred embodiment. As shown in FIG. 30A, low resistive portions 106 are formed at both ends of the integral formed main body in the resistive cylindrical device 105 applied in the preferred embodiment and a high resistive part 107 is formed between the resistive portions. In this case, it is preferable that a resistance value of the low resistive portions 106 at their surfaces is about 10 KΩ/□. In turn, it is preferable that the resistance value at the high resistive part 107 is from 100 MΩ to 10 TΩ in the same manner as that described above. Further, it is preferable that the high resistive part 107 is fabricated such that a resistance is continuously changed at an interface between it and the low resistive part 106. With such an arrangement as above, the potential gradient is further reduced.

The resistive cylindrical device 105 of the preferred embodiment of the present invention can be obtained by the method described in the well-known document (Slip Casting of Continuous Functionally Gradient Material Journal of the Ceramic Society of Japan 101 [7] 841–844, 1993 written by Jady Chu, Ishibashi, Hayashi, Takebe and Morinaga), for example. That is, this method is carried out such that slurry mixed with conductive substances (such as W, Ni—Cr or the like) is applied, a difference in settling speeds of the particles is utilized to make a difference in concentration in a direction of an axis of the tube to provide a resistance of the resistive cylindrical device 105 with certain gradient.

FIG. 20B shows another example of the resistive cylindrical device 108 in the preferred embodiment. As shown in this figure, the second high resistive part 109 is arranged around the resistive cylindrical device 105 shown in FIG. 30A in this example. The second high resistive part 109 is arranged in order to protect the low resistive part 106 or the like and as its material, the same material as that of the inner high resistive part 107 or other insulating members can be used.

In addition, only the part near the surface of the resistive cylinder (not shown) made of integral ceramics can also be changed to show a low resistance. For example, after coating the conductive substance to the inner surfaces at both ends of raw baked cylindrical device, the ceramics are regularly baked to enable the same low resistance part as that shown in FIG. 30B to be formed.

Figure 31:
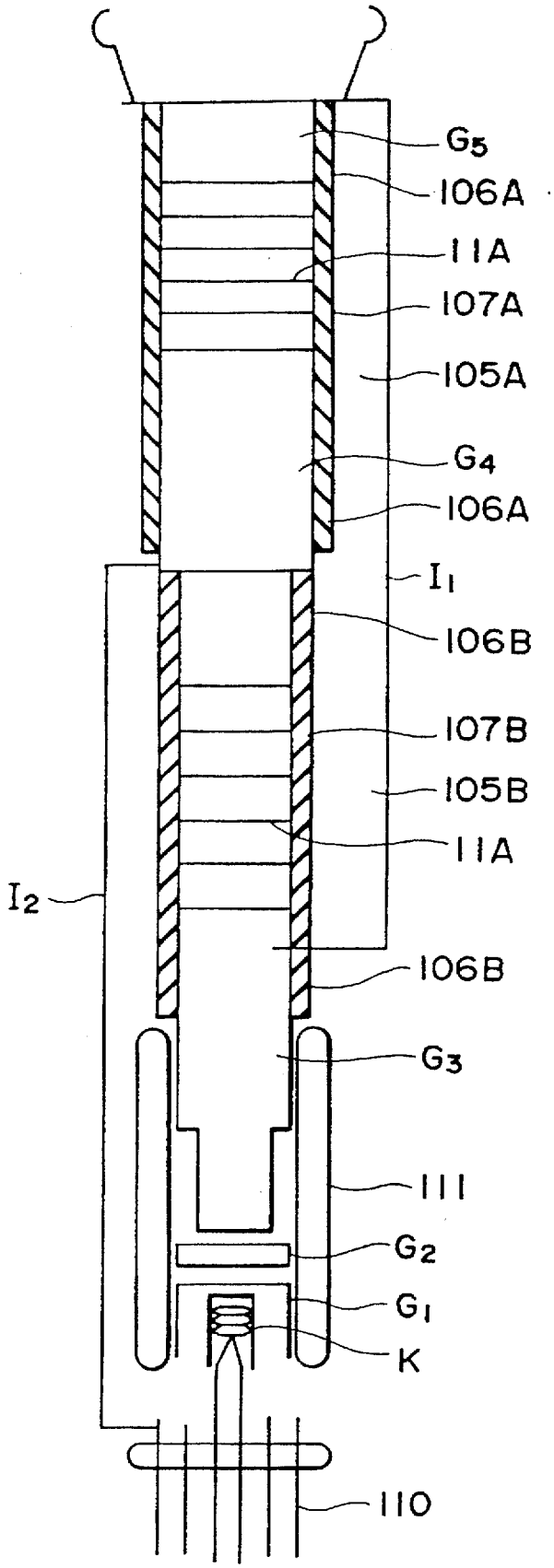
FIG. 31 is a view for showing an entire configuration of the fourth preferred embodiment.

FIG. 31 shows an entire configuration of the preferred embodiment of the present invention. As shown in this figure, in the case of this preferred embodiment, the aforesaid two resistive cylindrical devices 105A, 105B having different diameters from each other are used and a metallic member acting as the fourth grid $G_4$ is inserted into each of the resistive cylindrical devices 105A, 105B so as to fix these members. Then, the third grid $G_3$ and the fifth grid $G_5$ are fixed to each of the resistive cylindrical devices 105A, 105B. In addition, the aforesaid conductive layer 11A is arranged at each of the resistive cylindrical devices 105A, 105B. Further, the third and fifth grids $G_3$ and $G_5$ are connected by the lead line $1_1$ and concurrently the fourth grid $G_4$ and the stem pin 110 are connected by the lead line $1_3$. In addition, the cathode K, the first and second grids $G_1$, $G_2$ are arranged between the stem pin and the third grid $G_3$.

In accordance with the preferred embodiment of the present invention having the aforesaid configuration, it is possible to make a more inclined distribution of resistance, resulting in that an electrical discharging is hardly produced and concurrently it is further possible to form a lens system having a smaller aberration of lens and to realize a screen of high resolution.

In addition, in accordance with the present preferred embodiment, since it does not become necessary to perform the conductive paste coating, drying and baking steps, it becomes possible to simplify the steps and to attain a cost-down.

In accordance with the present preferred embodiment, since a sparking may easily be produced, it is possible to increase a pressure-tight state. In the aforesaid preferred embodiment, although the third to fifth grids $G_3$ to $G_5$ are fabricated by combining two resistive cylindrical devices 105A, 105B, the present invention is not limited to this preferred embodiment, but it may also be applicable that one resistive cylindrical device is formed with the low resistive parts corresponding to the third to fifth grids $G_3$ to $G_5$. In addition, the resistive cylindrical device is not limited to a cylindrical one, but a cylindrical member having an elliptical or rectangular sectional shape may also be used.

Figure 32:
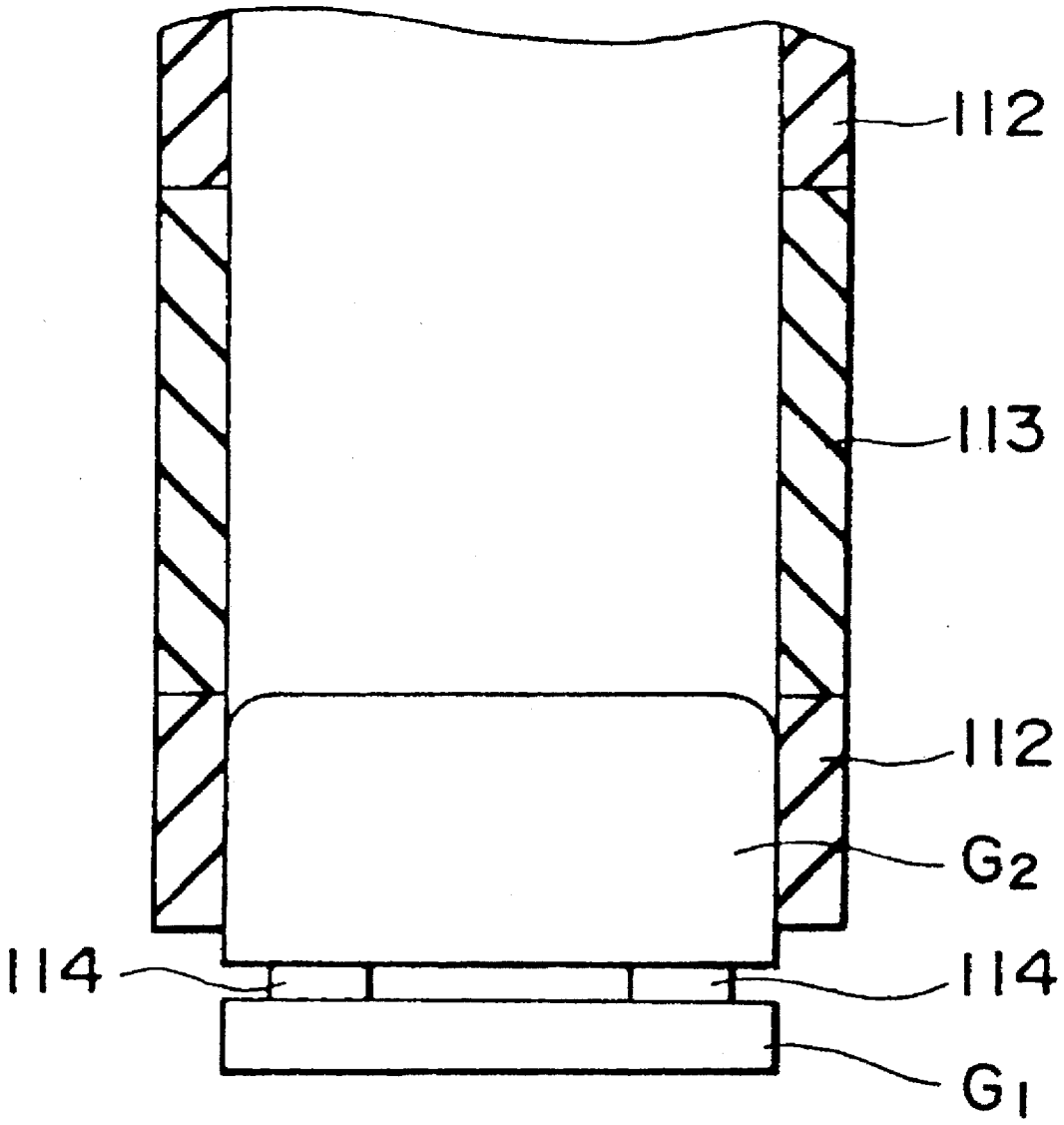
FIG. 32 is a view for showing an entire configuration of the fifth preferred embodiment of the present invention.
Figure 33:
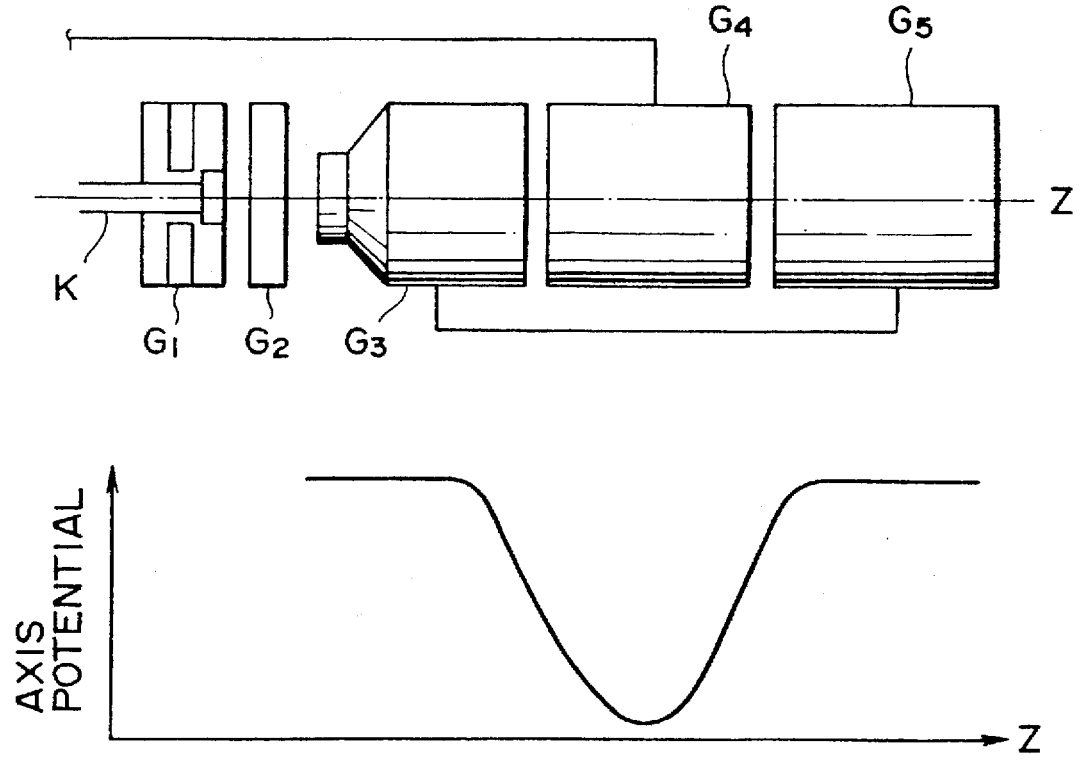
FIG. 33 is an illustrative view for showing a schematic configuration of the related art.

Further, the present invention can be applied not only to the main lens system, but also to a pre-focus lens system. In this case, as shown in FIG. 31, for example, two resistive cylindrical devices 105A, 105B are combined from each other, one resistive cylindrical device 105A is formed with two low resistive portions 105B and at the same time as shown in FIG. 32, the other resistive cylindrical device 105B is formed with the low resistive part 112 for the prefocusing lens system and the first and second grids $G_1$, $G_2$ are fixed to the end part of the resistive cylindrical device 105B. Reference numeral 114 denotes a spacer.

In accordance with the preferred embodiment having such a configuration as above, it is possible to simplify the configuration near the first and second grids $G_1$, $G_2$.

In turn, it is also possible to fabricate such that the resistive cylindrical device 105B is not formed with the low resistive part 112 for the pre-focusing lens system, but this can be acted as a supporting member. In this case, an electrical discharging may easily be carried out.

As described above, in the present invention, since the electron lens fabricating part is formed by the resistive cylinder, it is possible to restrict a displacement in a degree of concentricity of the electron lens system, to reduce an axial displacement of the electron beams and to realize a high quality image.

In addition, in the present invention, a ratio of b/a of a gap (a) between the first electrode and the third electrode in respect to a gap (b) between the third electrode and the second electrode is set to occupy a predetermined range, thereby a spherical aberration can be made to a minimum value and thereby a resolution of the cathode ray tube can be improved.

Further, since the outer circumference of the electrode is covered by the resistive cylindrical device, there is no possibility that the electron beams are leaked out of between the electrodes and they are charged up at the beading glass or the like.

What is claimed is:

1. A method of manufacturing a cathode ray tube, comprising the steps of: forming a first electrode layer on a cathode side of inner surface of a cylindrical device;

forming a second electrode layer on a panel side of inner surface of the cylindrical device;

forming a third electrode layer between the first electrode layer and the second electrode layer, a ratio of a gap between the second electrode and the third electrode to a gap between the first electrode and the third electrode being defined more than 1;

providing a pair of holders so as to hold both ends of the cylindrical device;

providing a voltage applying means on one of the pair of holders;

welding a plurality of electrodes which form a part of triode to the other of the pair of holders; and arranging the cylindrical device in a neck portion of envelope.

2. A method of manufacturing a cathode ray tube as recited in claim 1, further comprising:

forming a resistive layer on inner surface of the cylindrical device.

3. A method of manufacturing a cathode ray tube as recited in claim 1, further comprising:

forming a conductive layer on inner surface of the cylindrical device.

4. A method of manufacturing a cathode ray tube as recited in claim 3, wherein the electrode layers forming step and the conductive layer forming step comprise:

putting a roller and a conductive paste into the cylindrical device;

rotating the cylindrical device and the roller for coating the conductive paste on inner surface of the cylindrical device;

drying the conductive paste; and trimming the conductive paste so as to form the electrode layers and conductive layer.

5. A method of manufacturing a cathode ray tube as recited in claim 3, wherein the electrode layers forming step and the conductive layer forming step comprise:

forming a patterned resist layer;

depositing a metal on inner surface of the cylindrical device in a vacuum; and removing the patterned resist layer for forming the electrode layers and the conductive layer.

6. A method of manufacturing a cathode ray tube as recited in claim 1, wherein the electrode layers forming step comprises:

putting a roller and a conductive paste into the cylindrical device;

rotating the cylindrical device and the roller for coating the conductive paste on inner surface of the cylindrical device;

drying the conductive paste; and trimming the conductive paste so as to form the electrode layers.

7. A method of manufacturing an electron gun recited in claim 1, wherein the electrode layers forming step comprises:

forming a patterned resist layer;

depositing a metal on inner surface of the cylindrical device in a vacuum; and removing the resist layer for forming the electrode layers.

8. A method of manufacturing an electron gun recited as claim 1, wherein the electrode layers forming step comprises;

providing a conductive paste so as to form the electrode layers on outer surface of a cylindrical base film;

putting the cylindrical base film into the cylindrical device;

pressurizing and heating inner surface of the cylindrical device by using the roller having a heater; and removing the cylindrical base film for forming said plurality of electrode layers.

* * * * *